US008528242B2

(12) United States Patent
Green et al.

(10) Patent No.: US 8,528,242 B2
(45) Date of Patent: Sep. 10, 2013

(54) SAFETY DEVICE FOR A STRIKER FIRED WEAPON

(76) Inventors: Todd Louis Green, Rockville, MD (US); Thomas Hilton Jones, Los Alamos, NM (US)

( * ) Notice: Subject to any disclaimer, the term of this patent is extended or adjusted under 35 U.S.C. 154(b) by 190 days.

(21) Appl. No.: 13/135,312

(22) Filed: Jun. 30, 2011

(65) Prior Publication Data

US 2013/0000173 A1 Jan. 3, 2013

(51) Int. Cl.
*F41A 17/00* (2006.01)

(52) U.S. Cl.
USPC ..... 42/70.08; 42/70.11

(58) Field of Classification Search
USPC ..... 42/70.01–70.11
See application file for complete search history.

(56) References Cited

U.S. PATENT DOCUMENTS 6,601,331 B2 8/2003 Salvitti
7,703,230 B2 * 4/2010 Curry et al. ..... 42/70.08
7,827,720 B1 * 11/2010 Erdem ..... 42/70.08
2006/0162220 A1 * 7/2006 Curry et al. ..... 42/70.08

* cited by examiner

*Primary Examiner* — Michael David
(74) *Attorney, Agent, or Firm* — R. Tracy Crump

(57) ABSTRACT

The safety device provides an added measure of safety to striker fired semi-automatic pistols. The safety device includes a contact member in the form of a sliding bar or pivoting lever, that is movable between an engaged position and a disengaged position, such that the contact member operatively blocks the movement of one of the fire control mechanism components to prevent discharge of the weapon but only when the contact member is manually held in an engaged position. The user manipulates and physically holds the contact member in its engaged position by pressing a thumb plate or button located at the rear of the slide. Safety devices of this invention only affect the fire control mechanism of the pistol while the user actively engages, that is physically presses, on the thumb plate or button of the safety device to move the contact member into its engagement position, and must physically maintain pressure on the thumb plate in order to hold the contact member in its engaged position to block the movement of the fire control components.

33 Claims, 25 Drawing Sheets

SAFETY DEVICE FOR A STRIKER FIRED WEAPON

BACKGROUND OF THE INVENTION

Striker fired weapons, particularly semi-automatic pistols, are well known in the art. Unlike hammer fired weapons where a hammer is cocked and released by depressing the trigger to strike a firing pin to discharge the weapon, striker fired pistols use a series of linkage members that compress and release a spring loaded firing pin or "striker" when the trigger is pressed.

The fire control mechanism of a weapon generally refers collectively to the various trigger and safety components that operate to discharge a chambered round from the weapon. While the fire control mechanisms of various striker fired weapons and in particular a semi-automatic pistol, may vary greatly in design and operation, all conventional striker fired semi-automatic pistols include a trigger, a linkage member, commonly referred to as a "trigger bar" that is operatively connected to the trigger, and a spring loaded reciprocating firing pin or striker. In a striker fired pistol, the striker is disposed within the pistol slide, while the trigger and trigger bar are disposed within the pistol frame. When the trigger is pressed, the trigger bar is moved rearward causing the striker to be released and driven forward by spring tension. When the striker contacts the primer of the chambered round, the pistol is discharged. Once discharged, the slide cycles under recoil to reset the fire control mechanism for the next shot. Depending on the make and model, the fire control mechanism of a striker fired weapon may also include other linkage components of various design and function, such as the connectors used in pistols manufactured by Glock or the sears used in pistols manufactured by Smith & Wesson.

The fire control mechanisms of most conventional striker fired weapons also include a firing pin safety, which physically blocks the forward movement of the striker if the trigger is not pressed. Typically, the firing pin safety is a spring loaded block that projects into the firing pin channel of the pistol slide, arresting the movement of the firing pin within the firing pin channel. When the trigger is pulled to the rear, the trigger bar displaces the block clearing the firing pin channel and allowing the firing pin to spring forward firing the weapon.

One advantage of a hammer fired pistol is that they allow a user to "ride" the hammer with the thumb as the pistol is holstered. Riding the hammer during holstering dramatically reduces accidental discharges caused when a finger, some piece of clothing, or part of the holster is inadvertently caught inside the trigger guard as the pistol is pushed into the holster. The tactile pressure from the user's thumb on the hammer counteracts pressure exerted on the trigger when holstering, and more importantly any movement of the trigger is immediately felt by your thumb as the hammer starts to move. Unlike with a hammer fired pistol, a user has no source of tactile feedback about the condition of the fire controls when holstering, because the fire control mechanisms of a striker fired gun are all internal, except the trigger itself. Consequently, striker fired pistols are more prone to accidental discharges during holstering.

SUMMARY OF THE INVENTION

The safety devices of the present invention provide an added measure of safety to striker fired semi-automatic pistols. Several embodiments of the present invention are presented to illustrate the teaching of this invention. Each embodiment includes a contact member in the form of sliding bars or pivoting levers, that is movable between an engaged position and a disengaged position, such that the contact member operatively blocks the movement of one of the fire control mechanism components to prevent discharge of the weapon but only when the contact member is manually held in an engaged position. The user manipulates and physically holds the contact member in its engaged position by pressing a thumb plate or button located at the rear of the slide. Certain embodiments of this invention are designed to replace the slide cover plate of conventional striker fired weapons, while others are integrated directly into the design of the pistol and its fire control mechanism as a supplemental safety feature.

The safety devices of this invention only affect the operation of the weapon and the fire control mechanism when the user actively engages, that is physically presses the safety device, and must physically maintain the device in its engaged state to block the movement of the fire control components. The safety device operates in conjunction with the fire control mechanism to transfer any movement of the trigger to the thumb plate or button only when the safety device is actively engaged. When the user actively engages the safety device by pressing the thumb plate or button with his thumb, any movement of the trigger, whether pressed intentionally or inadvertently, will give the user a subtle tactile "warning" through the safety device. While the user will receive a subtle tactile "warning" alerting the user of a potential hazard, the safety device provides enough mechanical advantage against the movement of the fire control mechanism that the manual pressure applied to the thumb plate or button to actively engage the safety device arrests the movement of the trigger that would result in the weapon discharging. The safety devices do not operatively contact or otherwise affect the function of the fire control mechanisms unless the safety device is intentionally and actively engaged by the user. Consequently, the safety device does not alter the normal operation of the weapon.

These and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 2:
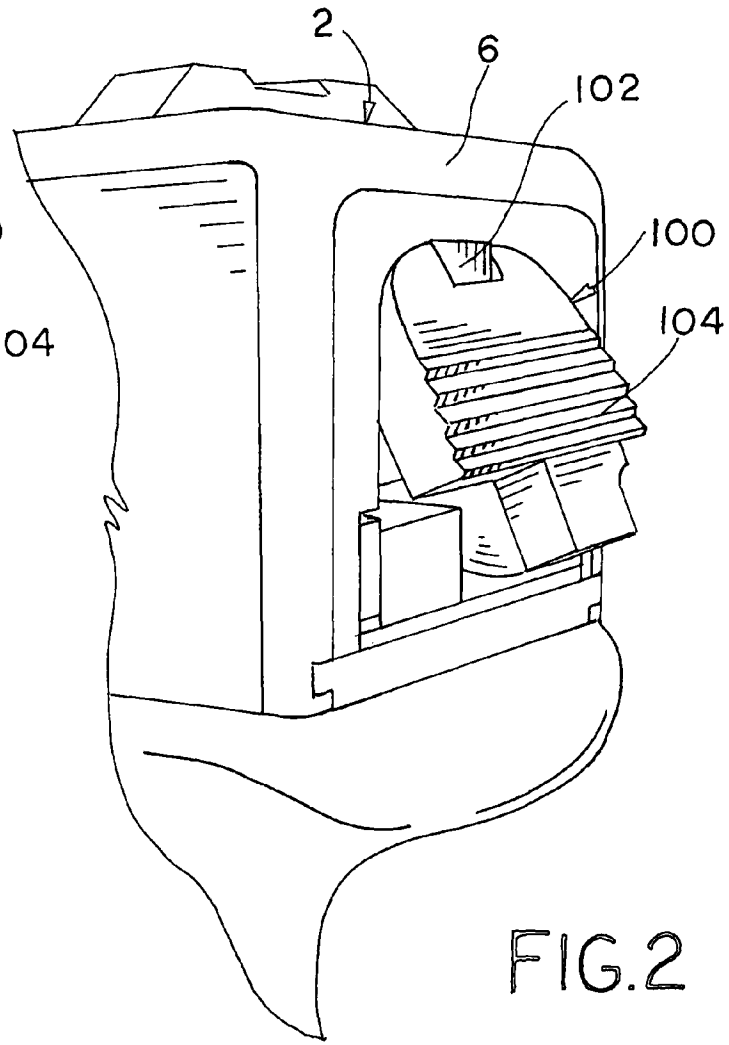
FIG. 2 is another partial perspective view of the rear of a striker fired pistol and the safety device of FIG. 1 in the disengaged position.

Each embodiment of the safety device of this invention herein illustrated and described is designed and intended for use with a striker fired semi-automatic weapon, such as certain pistols manufactured by Glock Ges.m.b.H, Springfield Armory, and Smith & Wesson Holding Company and other firearms manufacturers. Each embodiment of the safety device of this invention is illustrated and described in conjunction with an exemplary conventional striker fired semi-automatic pistol 2. The fire control mechanism of pistol 2 is presented in a simplified form for the purpose of simplicity of illustration and explanation only. It should be understood that the present invention may be modified or adapted to function within the teachings of this invention with any striker fired weapon, regardless of the particular design or specific components of the fire control mechanism employed by a particular weapon. The fire control mechanism of conventional striker fired pistols is well known and understood in the art. The illustrations and description of pistol 2 and its fire control mechanism are presented to provided a foundation for the description, explanation and understanding of the various embodiments of the safety devices of this present invention and how they interact with the basic components of the fire control mechanism of a typical striker fired pistol.

As shown in the figures for the various embodiments of this invention, fire control mechanism 10 of pistol 2 includes a trigger 12, a trigger bar 20, and a "striker" 30. Trigger 12 is pivotally mounted to the pistol frame 4 within the trigger well. Trigger bar 20 is a linkage element pivotally connected to trigger 12 and disposed within pistol frame 4 of pistol slide 6. Striker 30 is generally a spring loaded firing pin that is reciprocally disposed within an axial firing pin channel 31 formed inside pistol slide 6. Striker 30 is biased forward toward the chambered round (not shown) by a striker spring 34. As shown, the distal end of striker 30 terminates in a lug or foot 32. Trigger bar 20 has an integral leg or nub 22 that operatively engages lug 32 of striker 30 to move and hold the striker rearward against the bias of spring (not shown). Trigger bar 20 also has an intermediate protrusion 24. It is well known and should be understood that any particular fire control mechanism for a specific weapon may include various alternatives of these components along with other related components.

Fire control mechanism 10 also includes a firing pin safety 40 (shown in FIGS. 32-36). Firing pin safety 40 is disposed within a vertical bore 41 that opens into the firing pin channel 31 of the pistol slide 6, blocking striker 30 from moving forward. Firing pin safety 40 is biased by a spring 42 to position the block to obstruct firing pin channel 31. Trigger bar protrusion 24 seats up against the bottom of firing pin safety 40. When trigger 12 is pressed and trigger bar 20 moves rearward, trigger bar protrusion 24 pushes block 40 upward clearing firing pin channel 31 and allowing striker 30 to spring forward firing the weapon.

Figure 1:
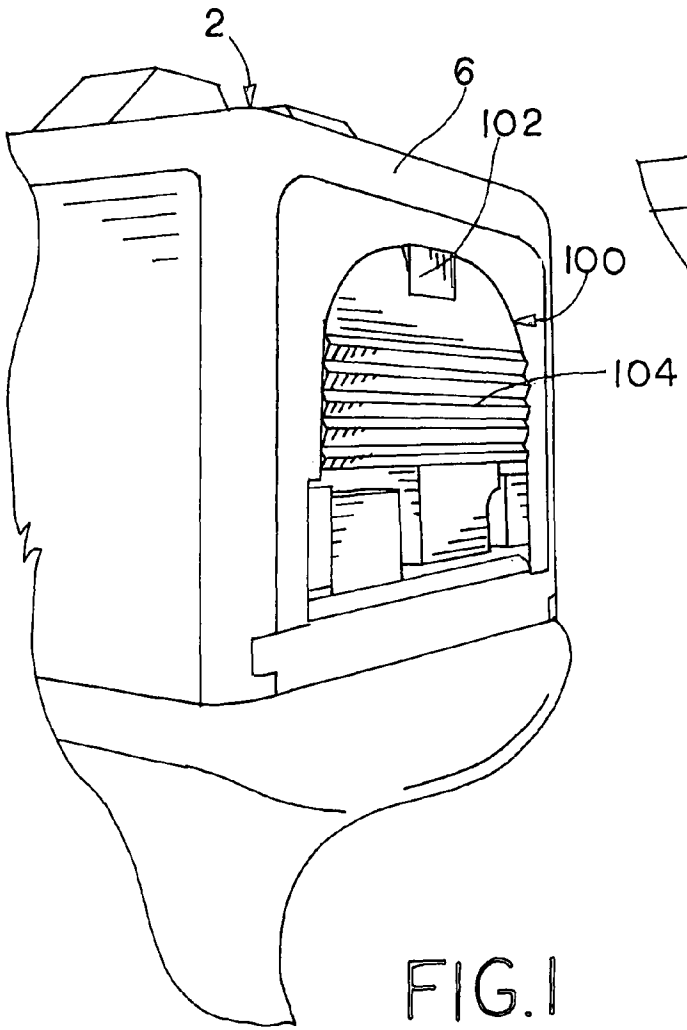
FIG. 1 is a partial perspective view of the rear of a striker fired pistol and one embodiment of the safety device of this invention in the engaged position.
Figure 3:
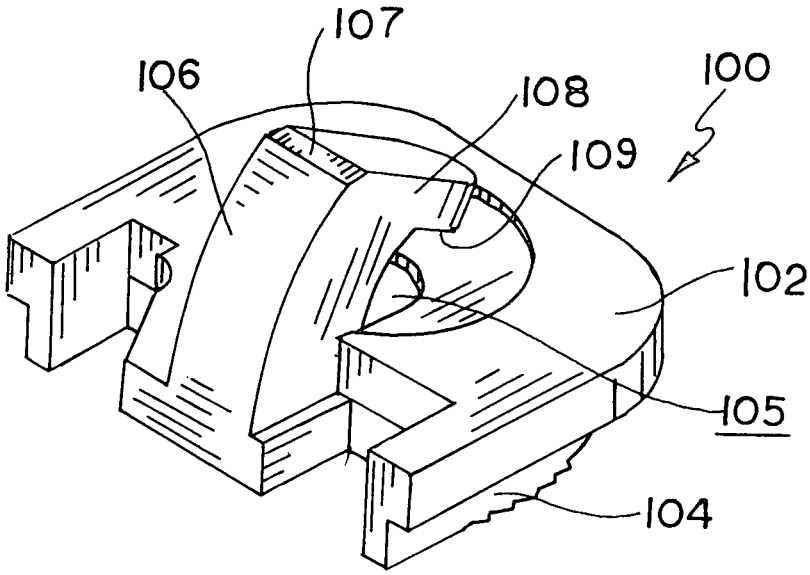
FIG. 3 is a perspective view of the safety device of FIG. 1 in the engaged position.
Figure 4:
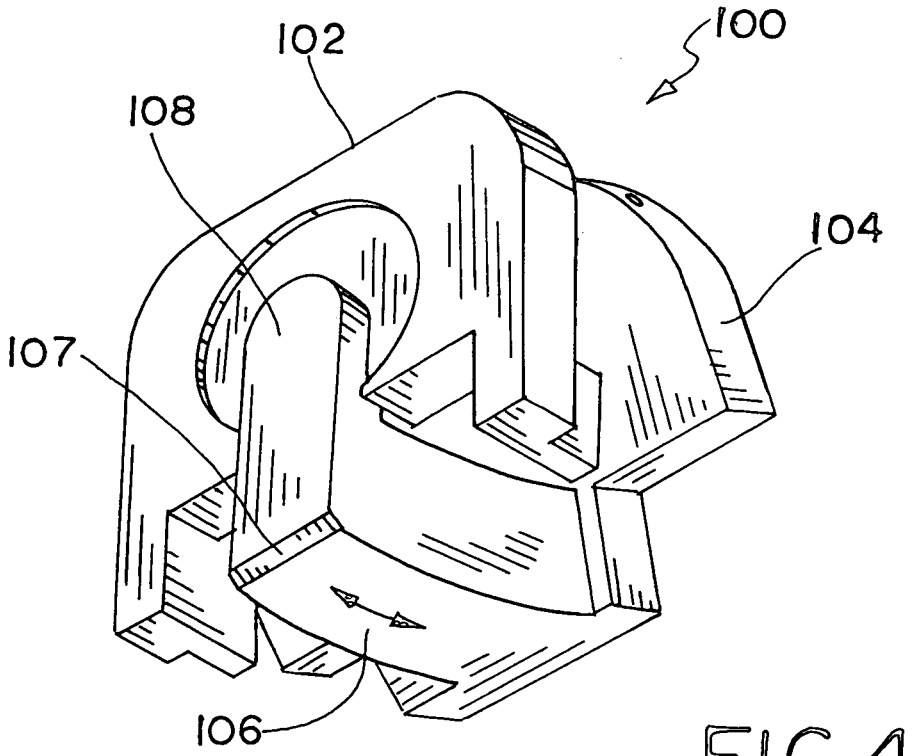
FIG. 4 is a perspective view of the safety device of FIG. 1 in the disengaged position.
Figure 5:
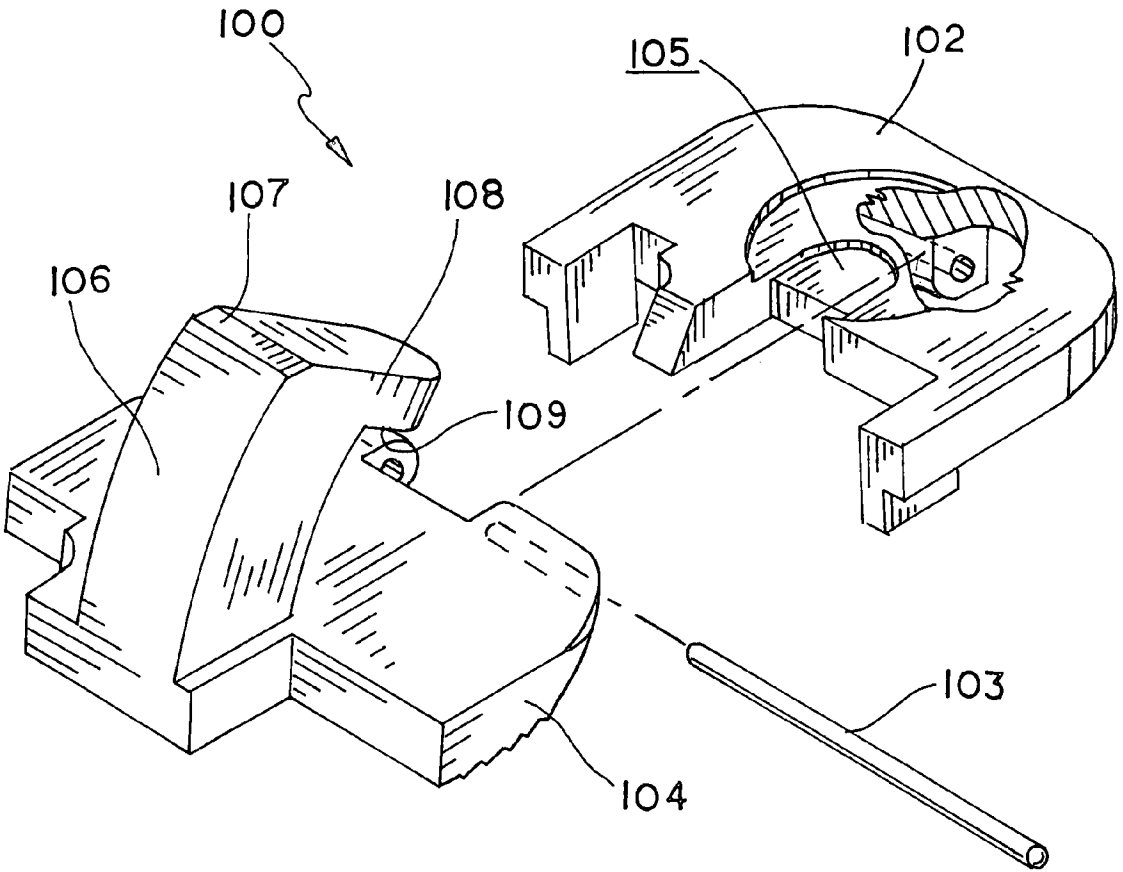
FIG. 5 is an exploded view of the safety device of FIG. 1.

Referring now to the drawings, FIGS. 1-15 illustrate an embodiment of the safety device of this invention, which is designated generally as reference numeral 100. As shown best in FIGS. 1-5, safety device 100 includes an end plate 102 and a thumb plate 104, which is pivotally hinged to the base plate by a pin 103. End plate 102 is configured as a replacement component for the convention slide cover plate and allows safety device 100 to mount directly to the rear of slide 6. Thumb plate 104 acts as the "activation button" for safety device 100 and pivots relative to end plate 102 between a disengaged position where the lever plate is spaced away from end plate 102 (FIGS. 2 and 4) and an engaged position where thumb plate 104 abuts flatly against the end plate 102 (FIGS. 1 and 3). Thumb plate 104 has an integral contact member in the form of a curved leg 106 that extends perpendicularly from the inner face of thumb plate 104 and under end plate 102. Contact leg 106 terminates in an integral foot 108 having a flat inner surface 109. Leg 106 also has a contact surface 107. As shown in FIG. 5, the pivotal movement of thumb plate 14 is limited by foot 108 abutting against the inside of end plate 102. End plate 102 has a recessed area 105 for receiving foot 108 when thumb plate 104 is in the disengaged position. When thumb plate 104 is in the engaged position, block leg 106 swings under end plate 102 and foot 108 is spaced from the inner face of end plate 102.

Figure 7:
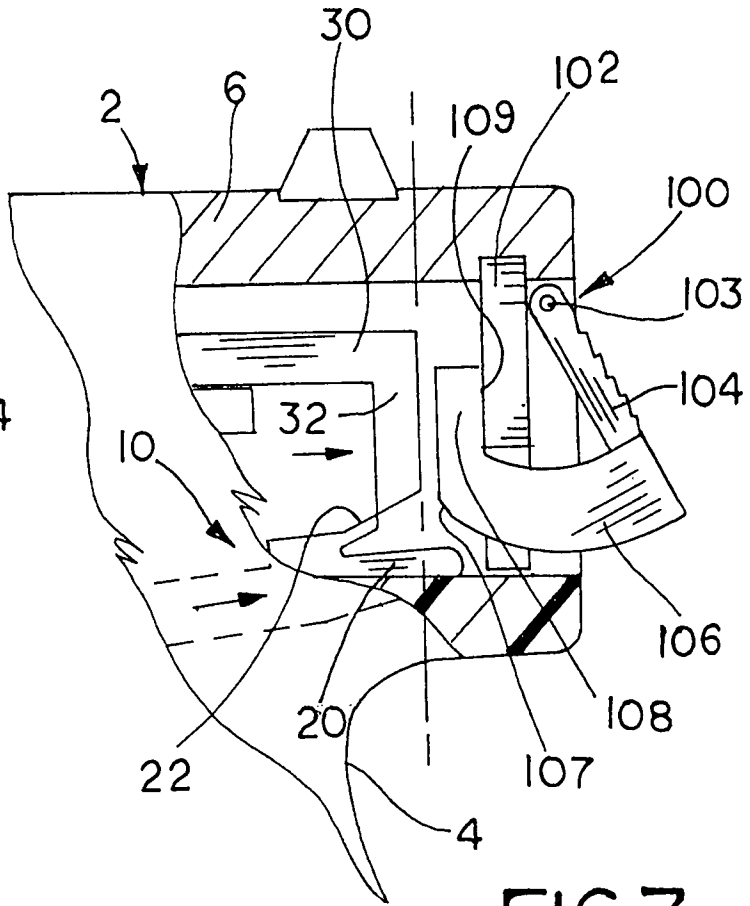
FIG. 7 is a partial sectional view of the rear of the striker fired pistol and the safety device of FIG. 1 in the disengaged position showing the trigger bar moving the striker rearward to the firing pin release point.
Figure 6:
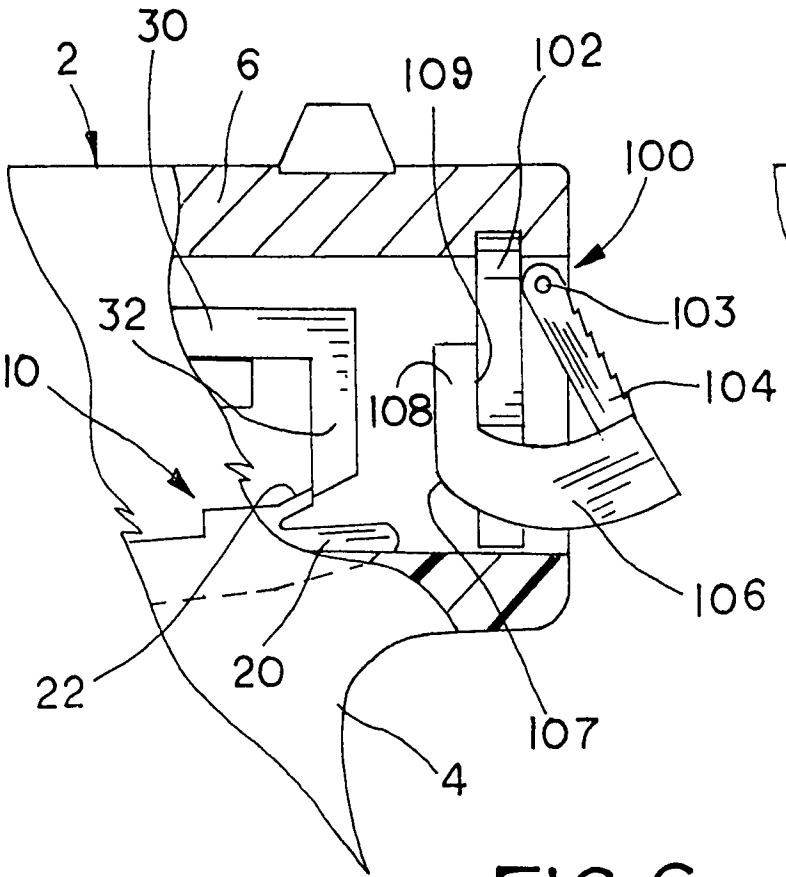
FIG. 6 is a partial sectional view of the rear of the striker fired pistol and the safety device of FIG. 1 in the disengaged position showing the trigger bar of the pistol's fire control mechanism at rest.
Figure 9:
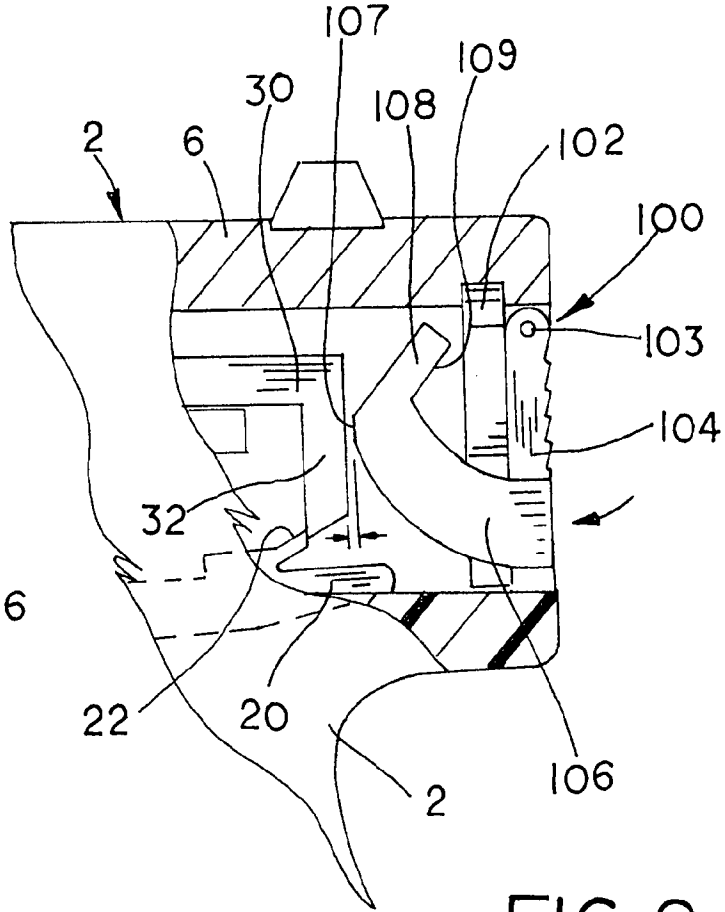
FIG. 9 is a partial sectional view of the rear of the striker fired pistol and the safety device of FIG. 1 in the engaged position showing the trigger bar at rest.
Figure 8:
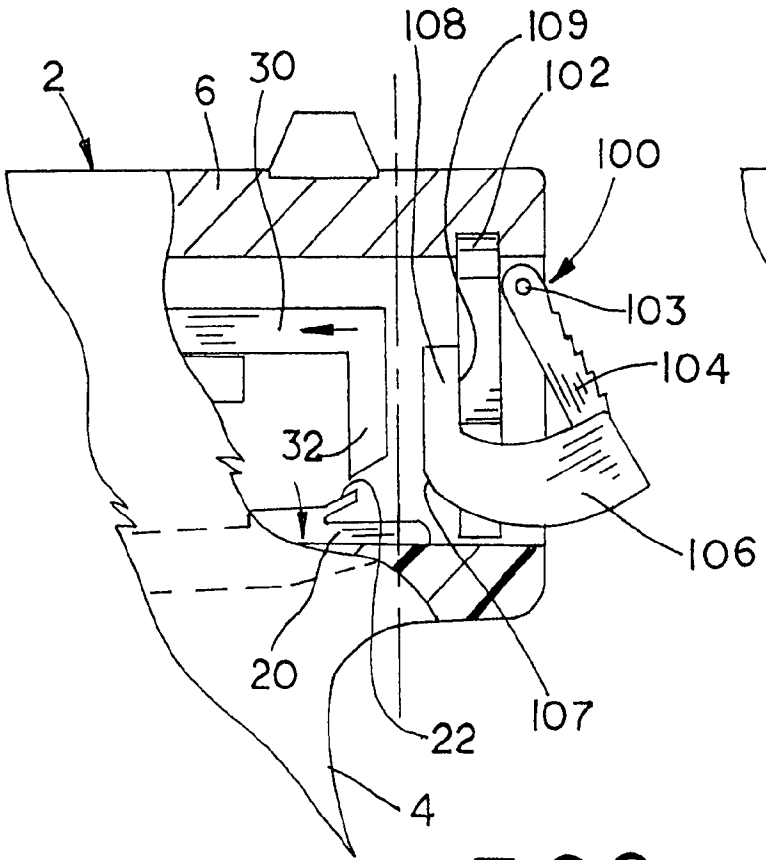
FIG. 8 is a partial sectional view of the rear of the striker fired pistol and the safety device of FIG. 1 in the disengaged position showing the trigger bar releasing the striker to discharge the pistol.
Figure 10:
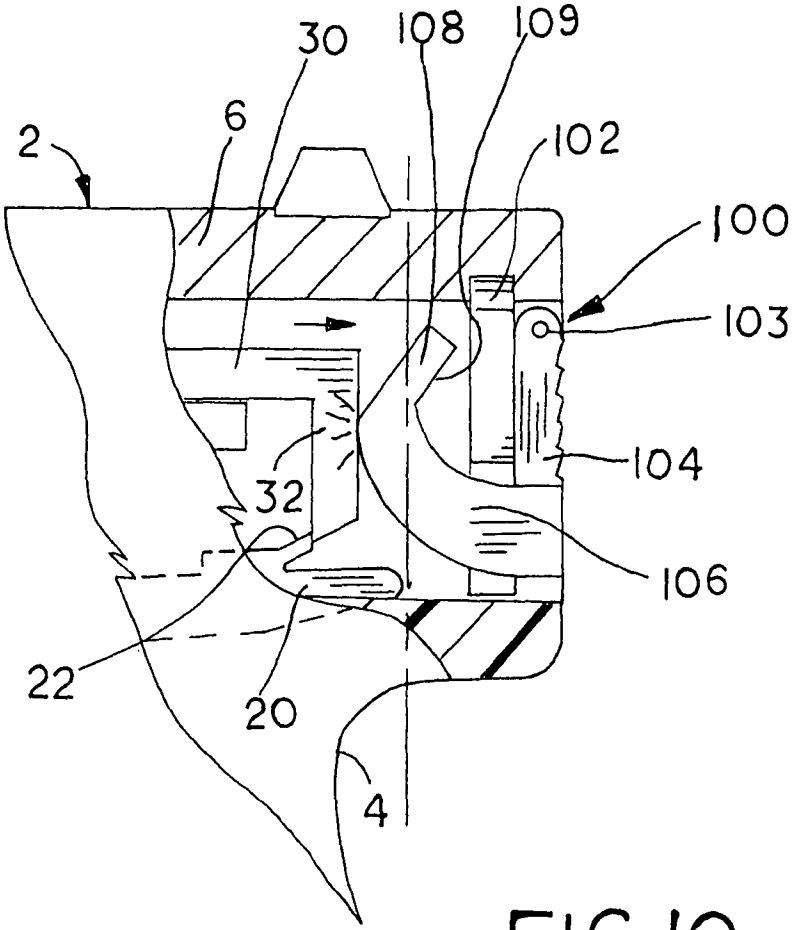
FIG. 10 is a partial sectional view of the rear of the striker fired pistol and the safety device of FIG. 1 in the engaged position showing the trigger bar blocked from rearward movement.

FIGS. 6-10, illustrate the operation of the safety device 100. FIG. 6 shows safety device 100 in the disengaged position and trigger 12, trigger bar 20 and firing pin 30 at their initial forward positions. FIG. 7 shows safety device 100 in its disengaged position and trigger 12 being pressed rearward, which moves trigger bar 20 and draws striker 30 rearward. It should be noted that in the disengaged position, contact leg 106 is spaced from the rearmost travel of firing pin 30 and does not otherwise contact or interfere with the movement of firing pin 30. FIG. 8 shows trigger bar 20 at the end of its rearward travel where it drops slightly to release striker 30, which is then driven forward to discharge the chambered round (not shown) in pistol 2. FIG. 9 shows safety device 100 in its engaged position and the fire control mechanism 100 at rest. It should be noted that when the trigger is at rest and safety device 100 is in its engaged position, contact surface 107 is spaced slightly from and does not directly contact firing pin 30. FIG. 10 shows safety device 10 in its engaged position blocking the rearward movement of striker 30. As shown, contact surface 107 contacts firing pin 30 and blocks any further rearward movement of the firing pin before it moves past the point where it is freed from trigger bar 20 and driven forward by firing pin spring 34 to discharge pistol 2.

Figure 12:
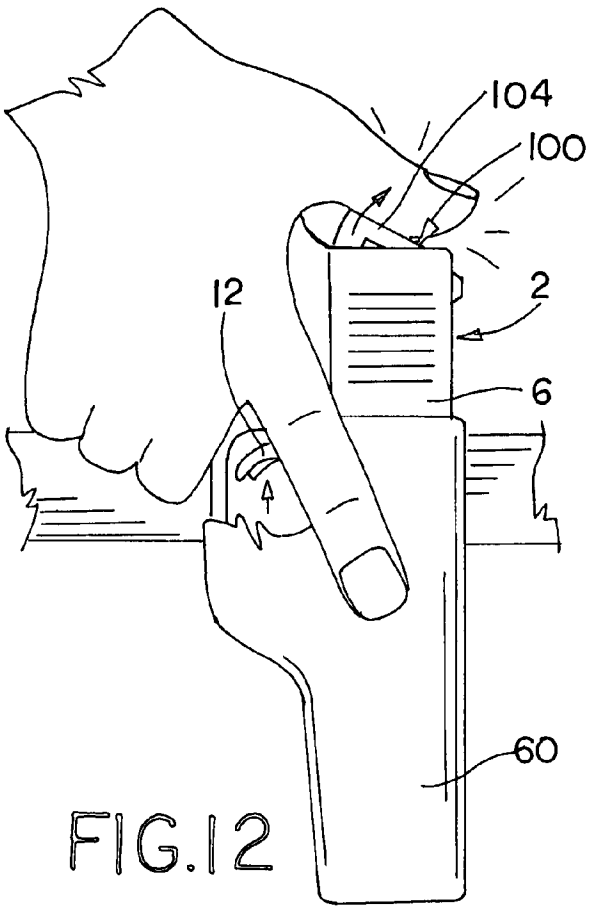
FIG. 12 is a side view of a user holstering the striker fired pistol and the safety device of FIG. 1 showing the user holding the thumb plate in the engaged position such that the rearward trigger is transferred to the safety device to give tactile feedback to the user.
Figure 11:
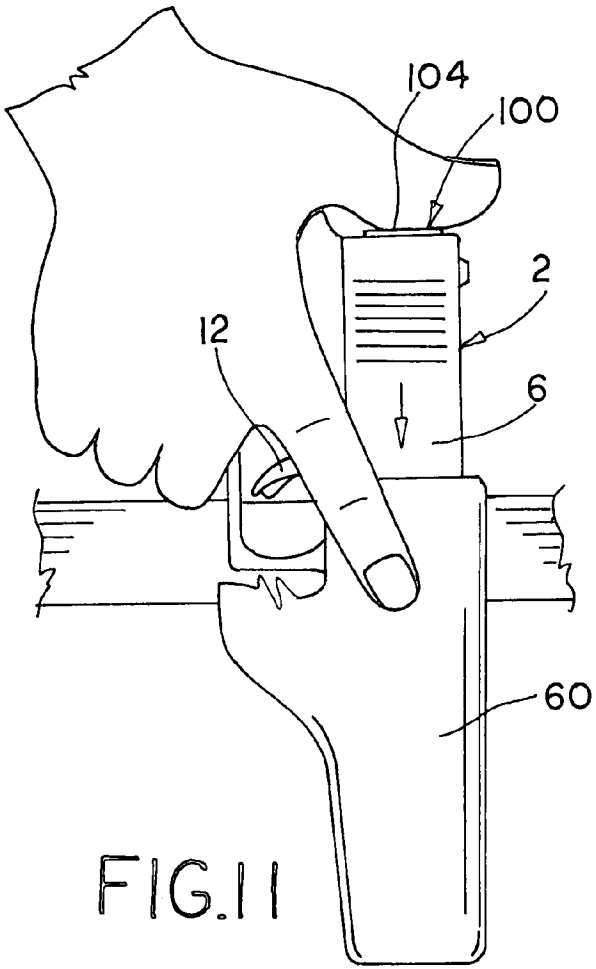
FIG. 11 is a side view of a user holstering the striker fired pistol and the safety device of FIG. 1 showing the user manually holding the thumb plate in the engaged position and no rearward movement of the trigger.

FIGS. 11-15 illustrate how safety device 100 is used to enhance weapon handling. When pistol 2 is holstered (FIG. 11) or purposely handled to prevent a discharge (FIG. 13), the user covers and manually depresses thumb plate 104 with his thumb. In the engaged position, any movement in the fire control mechanism is transferred to thumb plate 104. When physically held by the user in the engaged position, safety device 100 blocks the rearward movement of firing pin 30, thereby preventing pistol 2 from discharging. When a user manually depresses thumb plate 104 against end plate 102, any movement of fire control mechanism 10 is transferred into thumb plate 104 giving the user a tactile indication of the movement (FIG. 12). Consequently, if trigger 12 is inadvertently depressed when holstered, the user's thumb feels pressure on thumb plate 104 alerting the user of an impending inadvertent discharge. Typically, the manual pressure applied to thumb plate 104 is sufficient to prevent any inadvertent movement of trigger 12.

Figure 14:
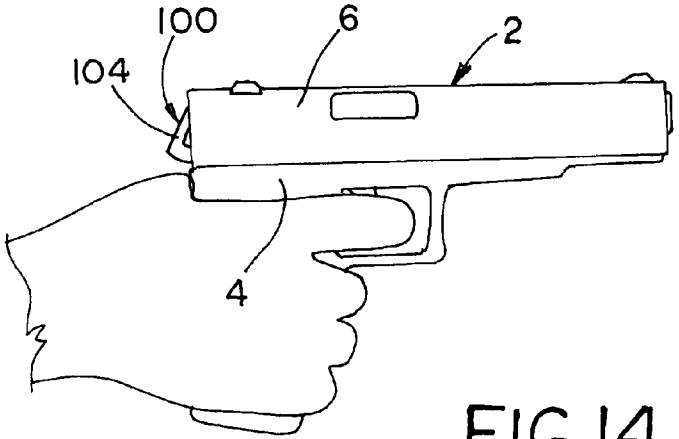
FIG. 14 is a side view of the striker fired pistol and the safety device of FIG. 1 in the disengaged position showing the pistol ready to be discharged.
Figure 13:
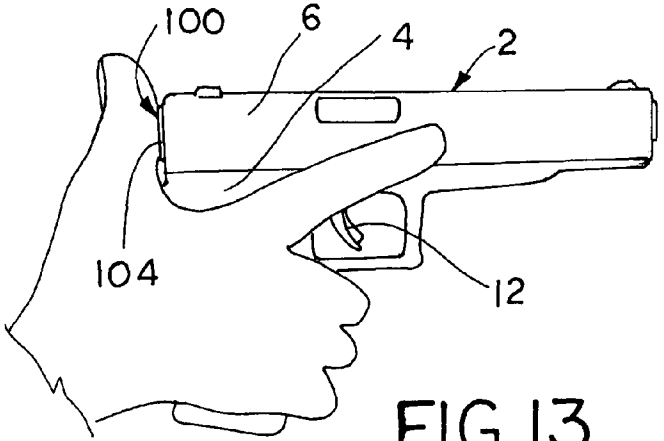
FIG. 13 is a side view of the striker fired pistol and the safety device of FIG. 1 showing the thumb plate held manually in the engaged position.
Figure 15:
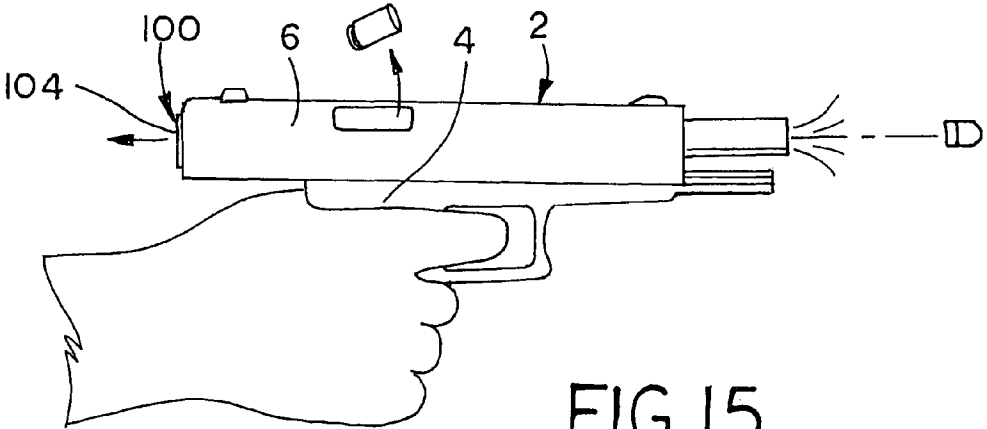
FIG. 15 is a side view of the striker fired pistol and the safety device of FIG. 1 being discharged.

Safety device 100 does not affect the normal use or operation of pistol 2. To fire pistol 2, the user simply assumes a conventional grip on the pistol (FIGS. 14 and 15). During normal use of pistol 2, thumb plate 104 is free to move between the engaged and disengaged position. Unless thumb plate 104 is manually depressed by the user's thumb, pistol 2 will cycle through its normal operation regardless of the position of the thumb plate. Consequently, the user must physically maintain safety device 100 in its engaged position to block the movement of fire control mechanism 10. Absent the user's intentional physical activation, safety device 100 will not alter or affect the normal operation of fire control mechanism 10. Even if safety device 100 is in its engaged position, pistol 2 will discharge when the trigger is pressed absent of any intentional manual pressure on thumb plate 104 from the user.

Figure 17:
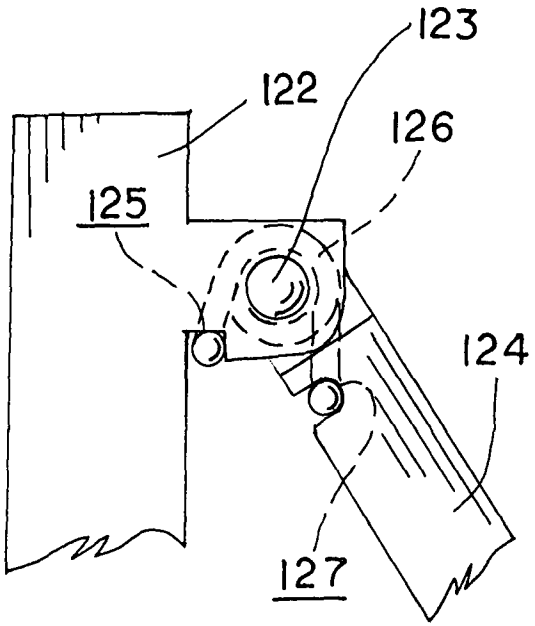
FIG. 17 is a partial side view of the safety device of FIG. 16.
Figure 16:
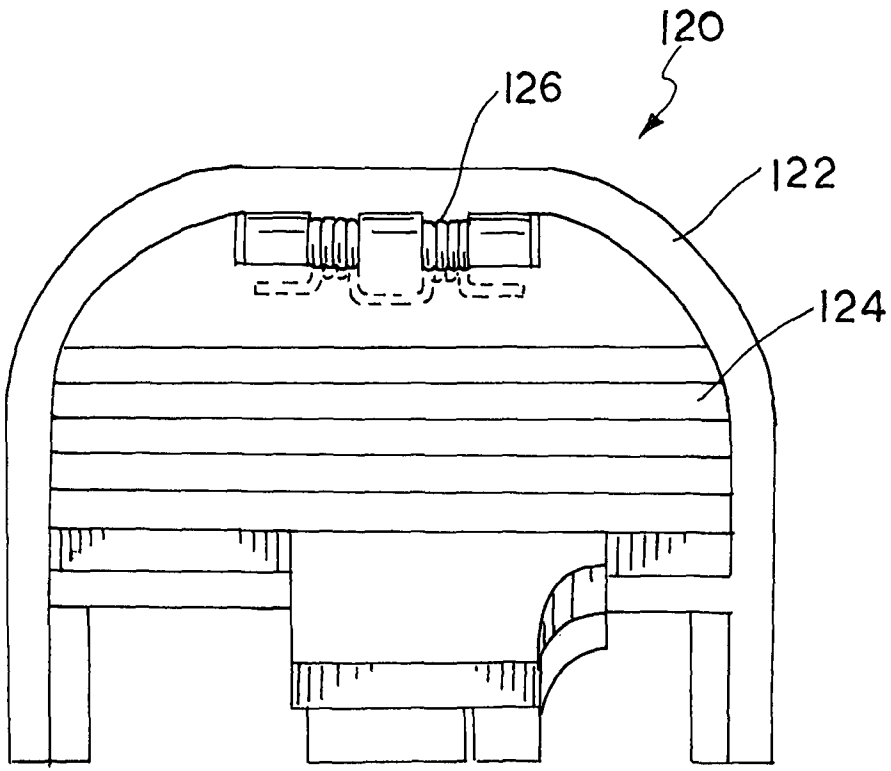
FIG. 16 is an end view of a second embodiment of the safety device of this invention.
Figure 19:
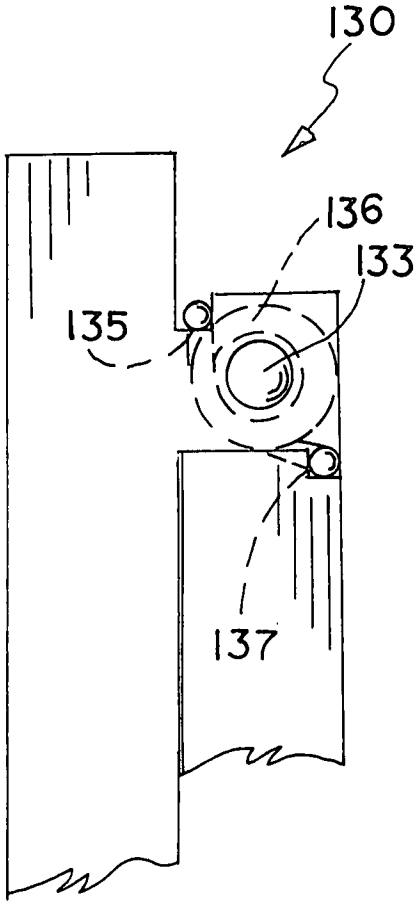
FIG. 19 is a partial side view of the safety device of FIG. 18.
Figure 18:
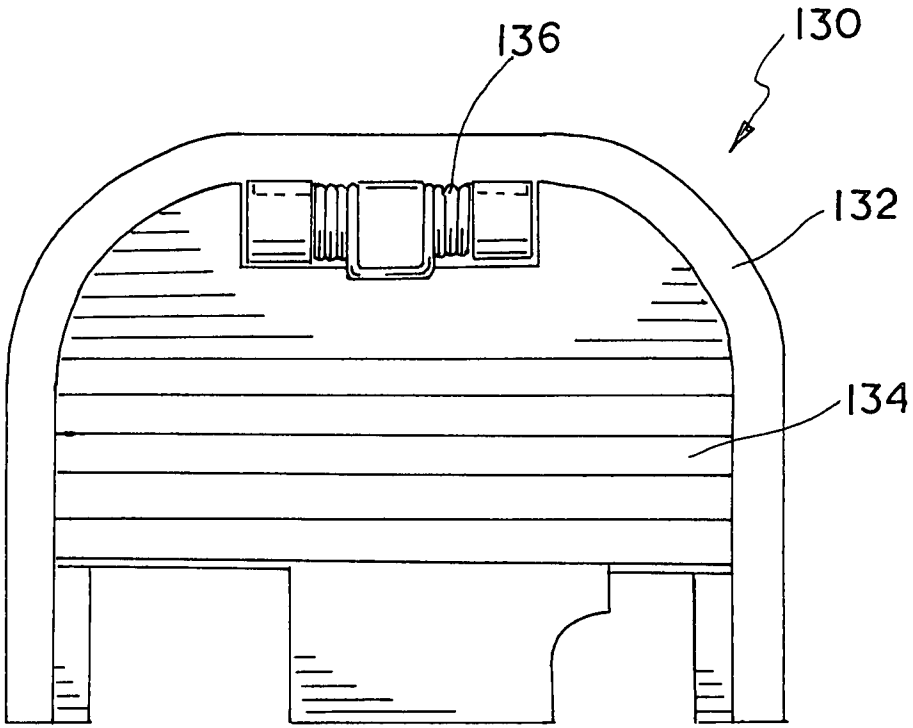
FIG. 18 is an end view of a third embodiment of the safety device of this invention.

FIGS. 16-19 illustrate a second and third embodiment of the safety devices of this invention, which are designated as reference numerals 120 and 130 respectively. These two embodiments are identical to safety device 100 in construction and operation, except that they include torsion springs 126 and 136 to hold thumb plate 124 and 134, respectively, in either the engaged position or disengaged position. As shown in FIGS. 16 and 17, spring 126 of safety device 120 is seated over pin 123 with its end restrictively seated against shoulders 125 and 127 formed in end plate 122 and thumb plate 124, respectively to hold thumb plate 124 in the disengaged position. As shown in FIGS. 18 and 19, spring 136 is seated over pin 133 with its end restrictively seated against shoulders 135 and 137 formed in end plate 132 and thumb plate 134, respectively to hold thumb plate 134 in the engaged position.

Figure 21:
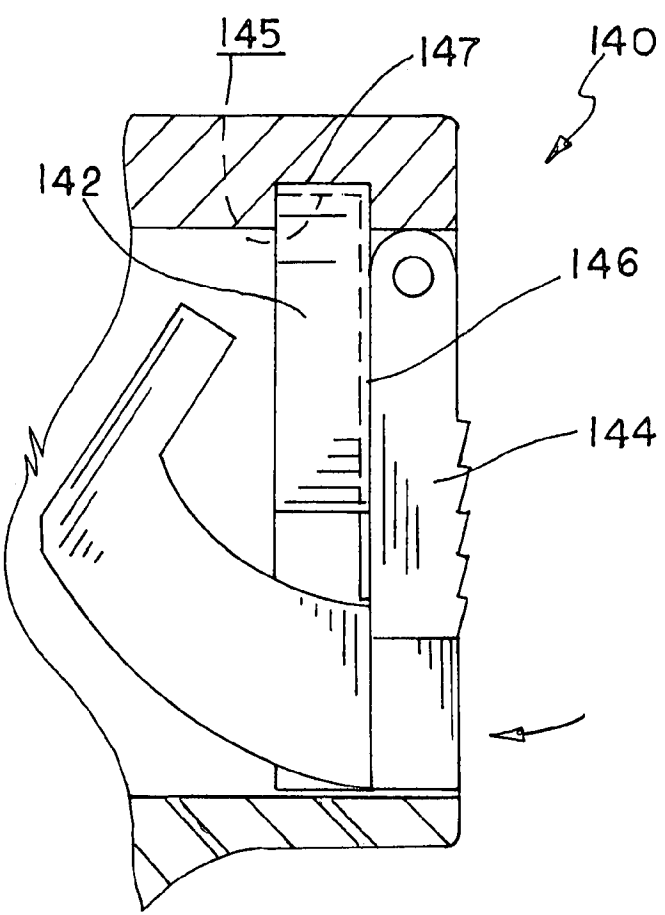
FIG. 21 is a partial side view of the rear of the striker fired weapon and of the safety device of FIG. 20.
Figure 20:
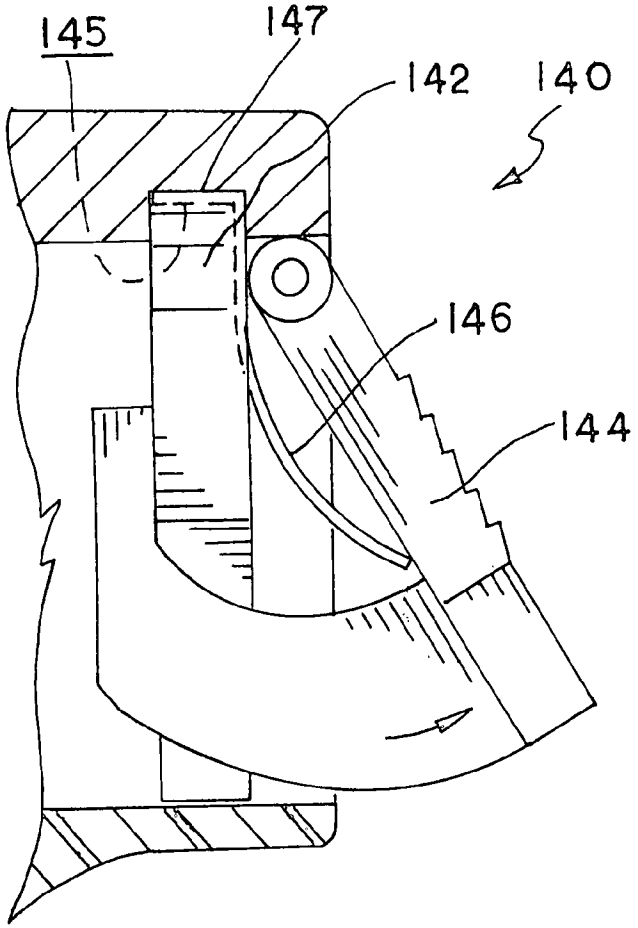
FIG. 20 is a partial side end view of the rear of the striker fired weapon and a fourth embodiment of the safety device of this invention.
Figure 23:
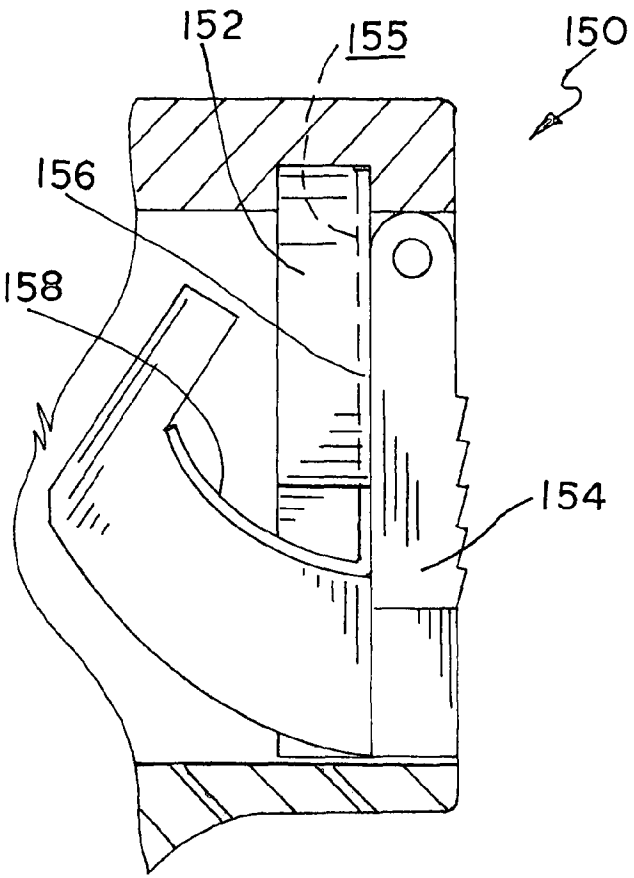
FIG. 23 is a partial side view of the rear of the striker fired weapon and of the safety device of FIG. 23.
Figure 22:
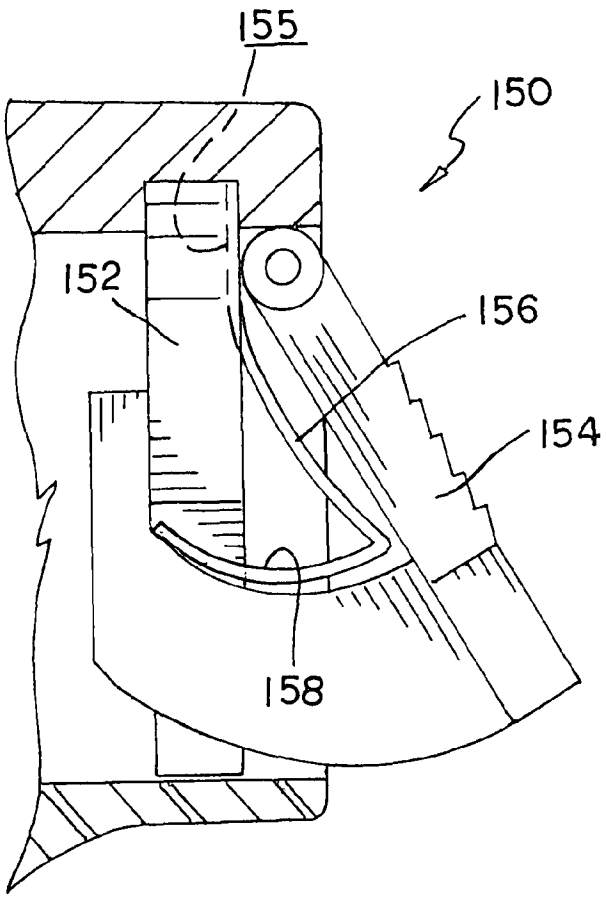
FIG. 22 is a partial side view of the rear of the striker fired weapon and a fifth embodiment of the safety device of this invention.
Figure 25:
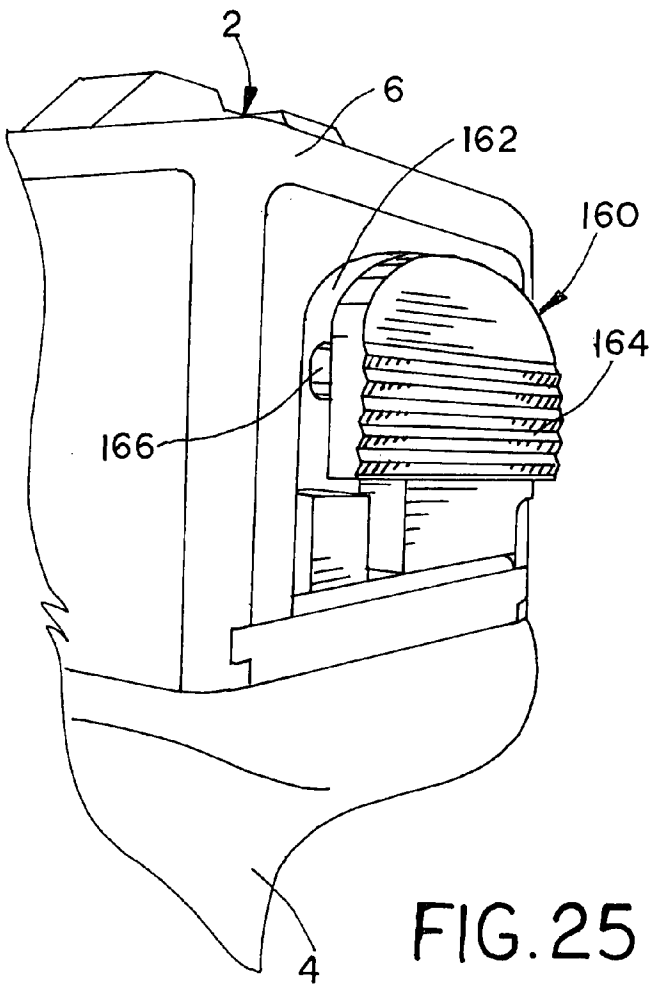
FIG. 25 is another partial perspective view of the rear of the striker fired pistol and the safety device of FIG. 24 in the disengaged position.
Figure 24:
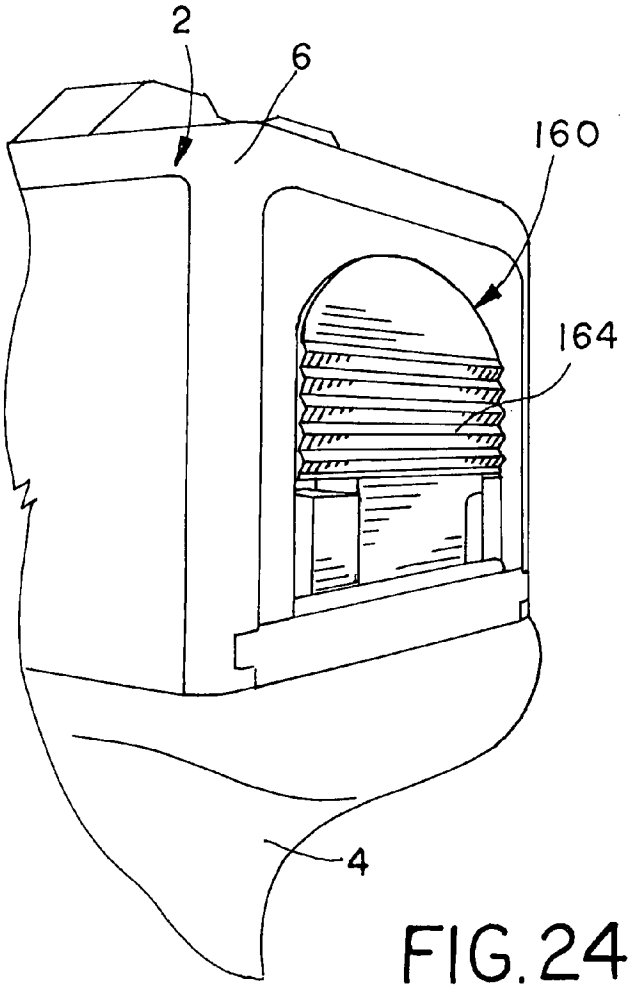
FIG. 24 is a partial perspective view of the rear of a striker fired pistol and a sixth embodiment of the safety device of this invention in the engaged position.
Figure 26:
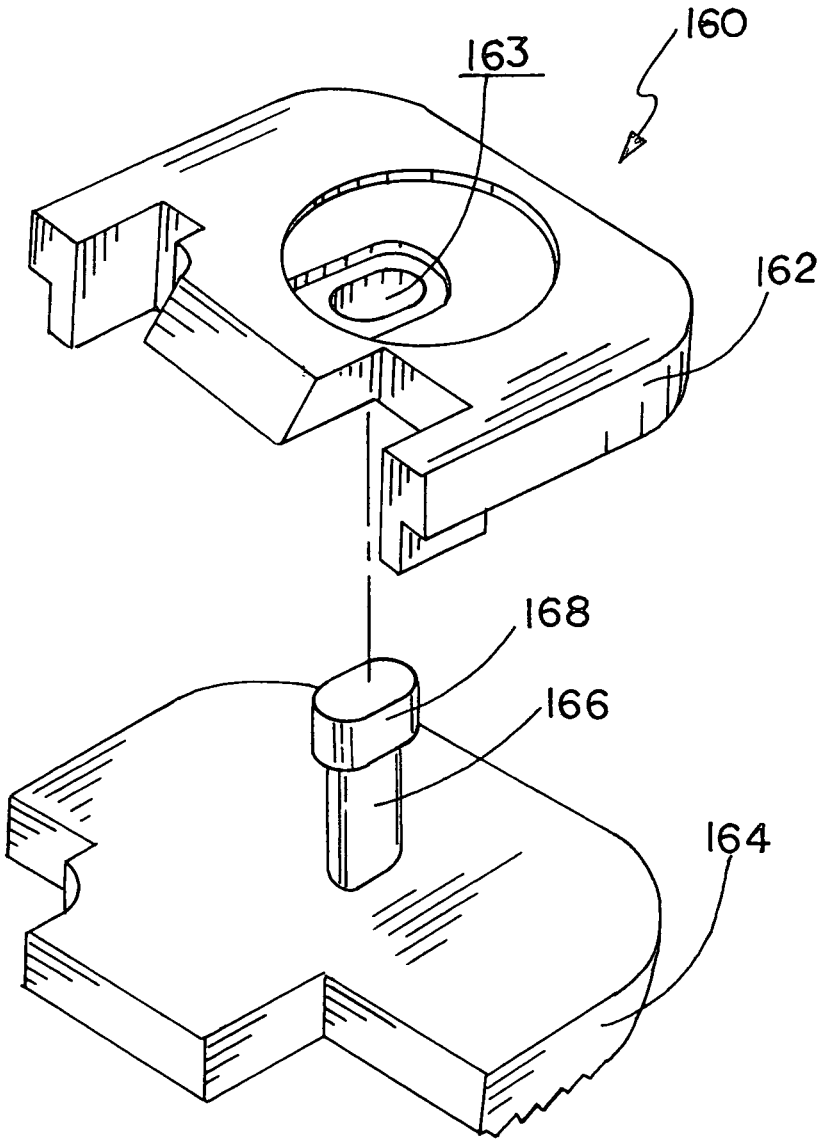
FIG. 26 is an exploded view of the safety device of FIG. 24.
Figure 28:
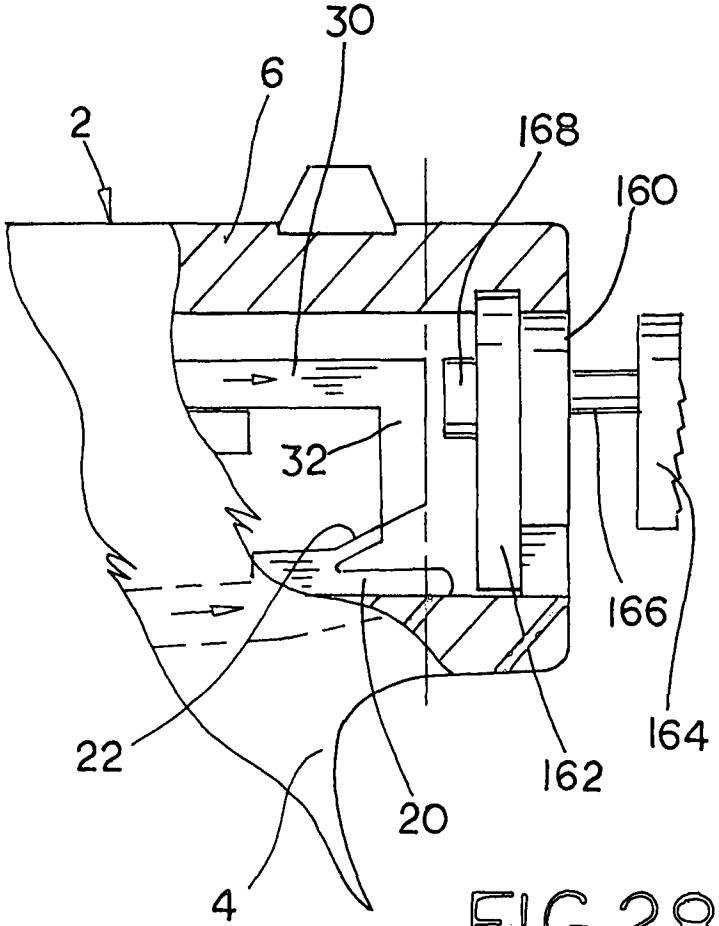
FIG. 28 is a partial sectional view of the rear of the striker fired pistol and the safety device of FIG. 24 in the disengaged position showing the trigger bar moving the striker rearward.
Figure 27:
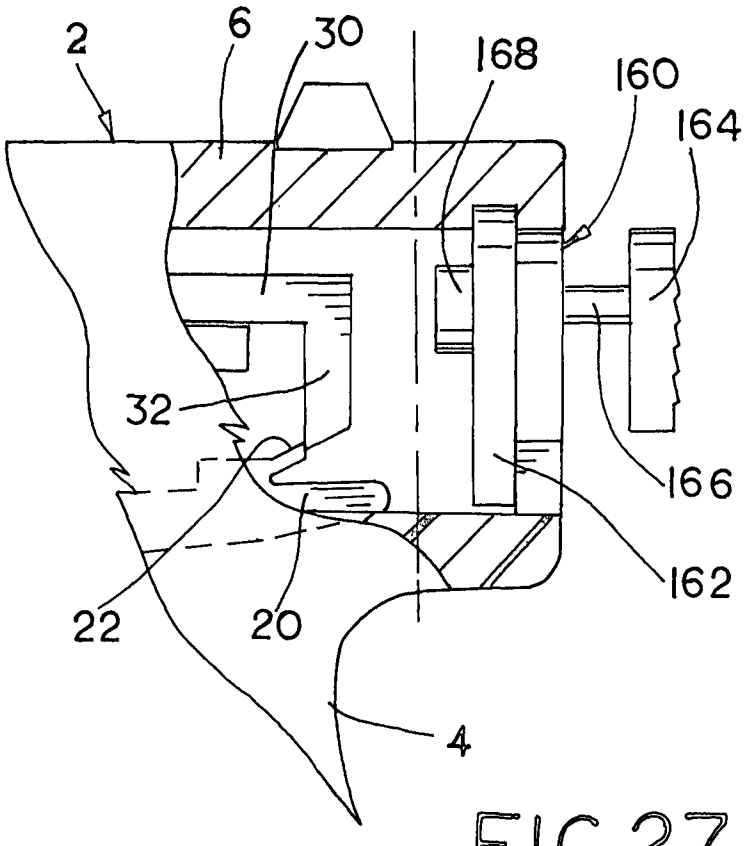
FIG. 27 is a partial sectional view of the rear of the striker fired pistol and the safety device of FIG. 24 in the disengaged position showing the trigger bar of the pistol's fire control mechanism at rest.
Figure 30:
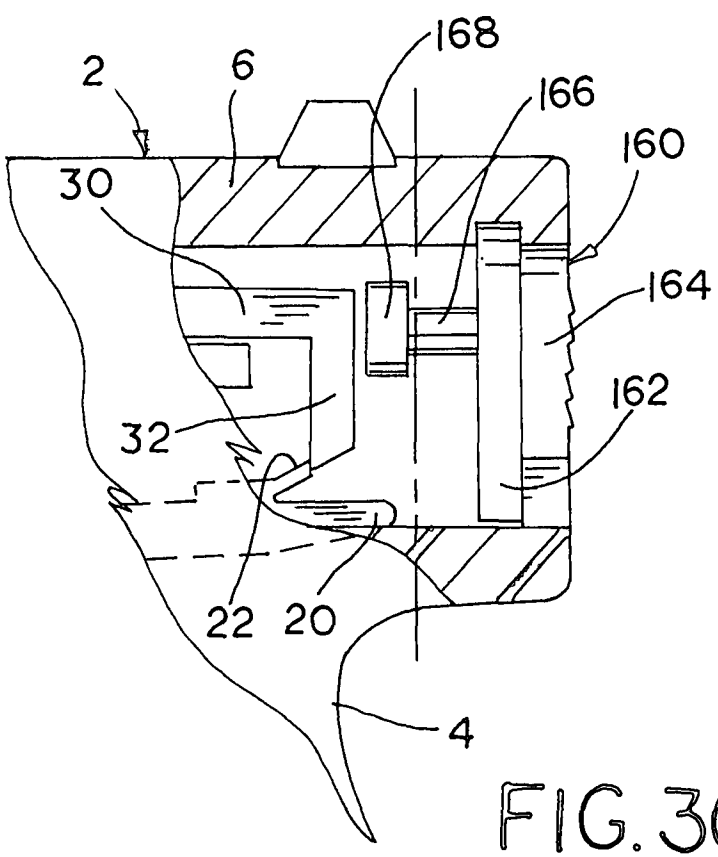
FIG. 30 is a partial sectional view of the rear of the striker fired pistol and the safety device of FIG. 24 in the engaged position showing the trigger bar at rest.
Figure 29:
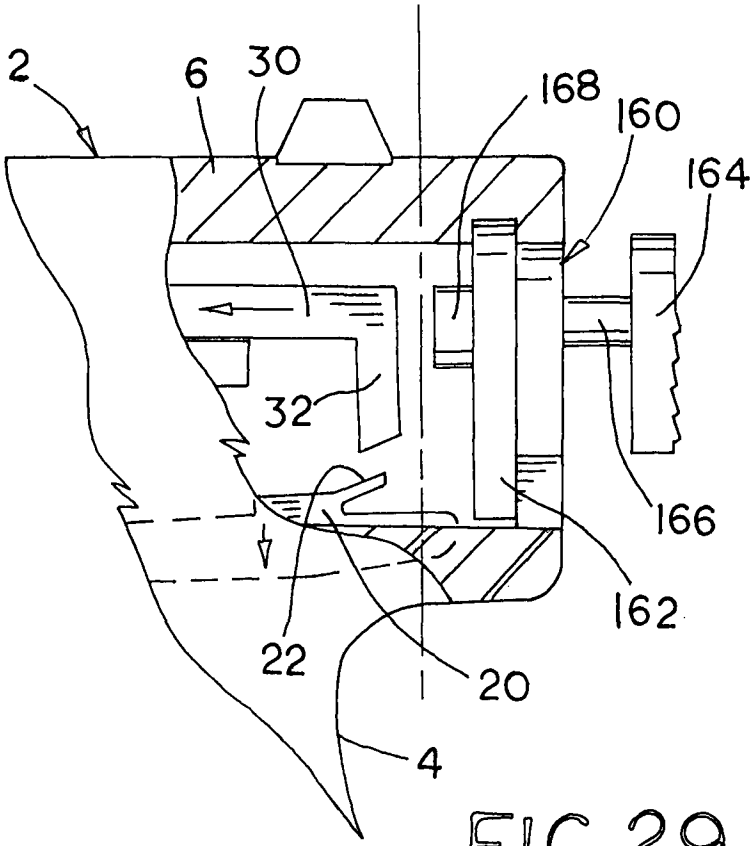
FIG. 29 is a partial sectional view of the rear of the striker fired pistol and the safety device of FIG. 24 in the disengaged position showing the trigger bar releasing the striker to discharge the pistol.
Figure 31:
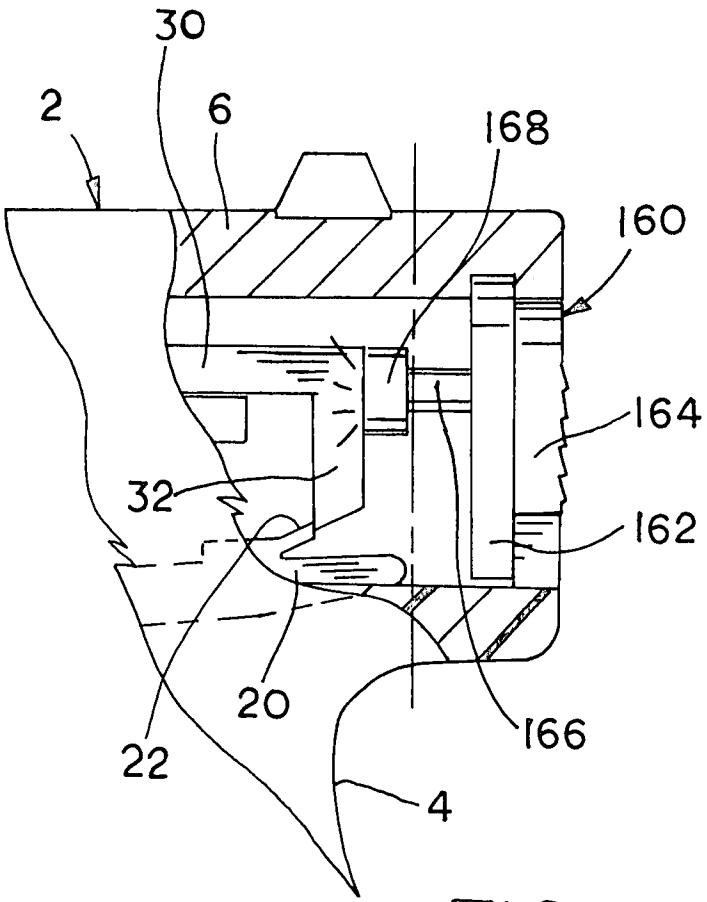
FIG. 31 is a partial sectional view of the rear of the striker fired pistol and the safety device of FIG. 24 in the engaged position showing the trigger bar blocked from rearward movement.

FIGS. 20-23 illustrate a fourth and fifth embodiment of the safety device of this invention, which are designated as reference numerals 140 and 150 respectively. Again, these two embodiments are identical to safety device 10 except that they include flat or bar springs 146 and 156 to hold the thumb plate 144 and 154, respectively, in either the engaged position or disengaged position respectively. As shown in FIGS. 20 and 21, spring 146 has a bent foot 147, which is held within a recessed slot 145 in the top of end plate 142. Spring 146 acts against thumb plate 144 to hold the button plate in the disengaged position. As shown in FIGS. 22 and 23, spring 156 is held within a recessed slot 155 of end plate 152 and has a bent leg 158 that abuts against the contact leg to hold thumb plate 154 in the disengaged position.

FIGS. 24-31 illustrate a sixth embodiment of the safety device, designated generally as reference numeral 160. Safety device 160 is similar to safety device 100, except that it uses a plunger style contact member in the form of a reciprocating bar or rod 166, instead of a swinging contact member extending from the hinged thumb plate, as in safety device 100. Safety device 160 includes an end plate 162 and thumb plate mounted to the end of contact rod 166. Again, end plate 162 is configured as a replacement component for the conventional slide cover plate and allows safety device 160 to mount directly to the rear of slide 6. Contact rod 166 terminates in a contact head 168. As shown, contact rod 166 reciprocally extends through an opening 163 in the end plate for movement between an engaged position (FIGS. 24, 30 and 31) where thumb plate 164 abuts flat against end plate 162 and a disengaged position (FIGS. 25, 27-29) where the thumb plate is spaced from the end plate.

FIGS. 28-31, illustrate the use and operation of safety device 160, which is nearly identical to that of safety device 100. When thumb plate 164 is in the disengaged position, contact head 168 abuts the back of end plate 162. Manually depressing thumb plate 164 against end plate 162 to the engaged position extends post 166 into the slide interior so that contact head 168 will contact striker 30 blocking the rearward movement of the striker required to discharge pistol 2. In the engaged position, any rearward movement of trigger 12, trigger bar 20 or striker 30 is transferred to thumb plate 164, which gives the user tactile feedback as to the movement of the trigger. During normal use of pistol 2, thumb plate 164 is free to move between the engaged and disengaged position. Again, it should be noted that in the engaged position, contact head 168 does not contact striker 30 or any other component of the fire control mechanism when trigger 12 is at rest and only contacts the striker once it begins to move rearward. In addition, absent any manual pressure exerted by the user on thumb plate 164, regardless of its position, safety device 160 does not affect the normal operation of fire control mechanism 10. Even in the engaged position, without any manual pressure on thumb plate 164, pistol 2 will cycle through its operation and striker 30 will simply move to displace the thumb plate back into its disengaged position when trigger 12 is pressed.

It should be noted that safety devices 100, 120, 130, 140, 150 and 160 are designed and intended to be used as a replacement component for the existing slide cover plate of a conventional striker fired pistol, however, they may be incorporated directly into the design and configuration of the pistol as desired. The use of these particular embodiments do not require any physical change or modification to the pistol or its fire control mechanism. As a single replacement component to the slide back cover, these embodiments provide cost effective add-on safety devices for conventional striker fired weapons.

Figure 32:
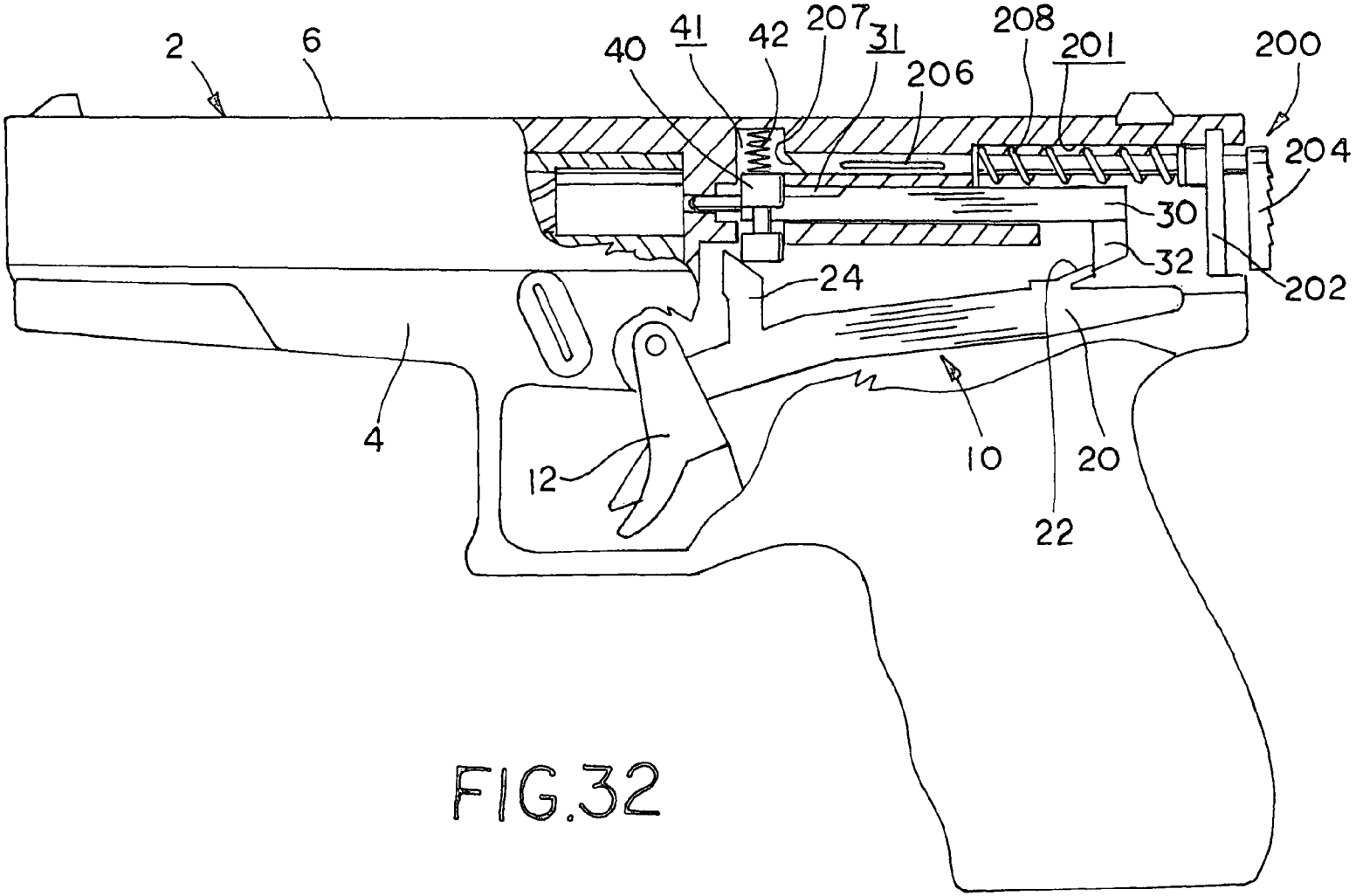
FIG. 32 is a side view with a cut away portion of the striker fired pistol and a seventh embodiment of the safety device of this invention in the disengaged position showing the trigger, trigger bar and firing pin safety of the pistol's fire control mechanism at rest.
Figure 33:
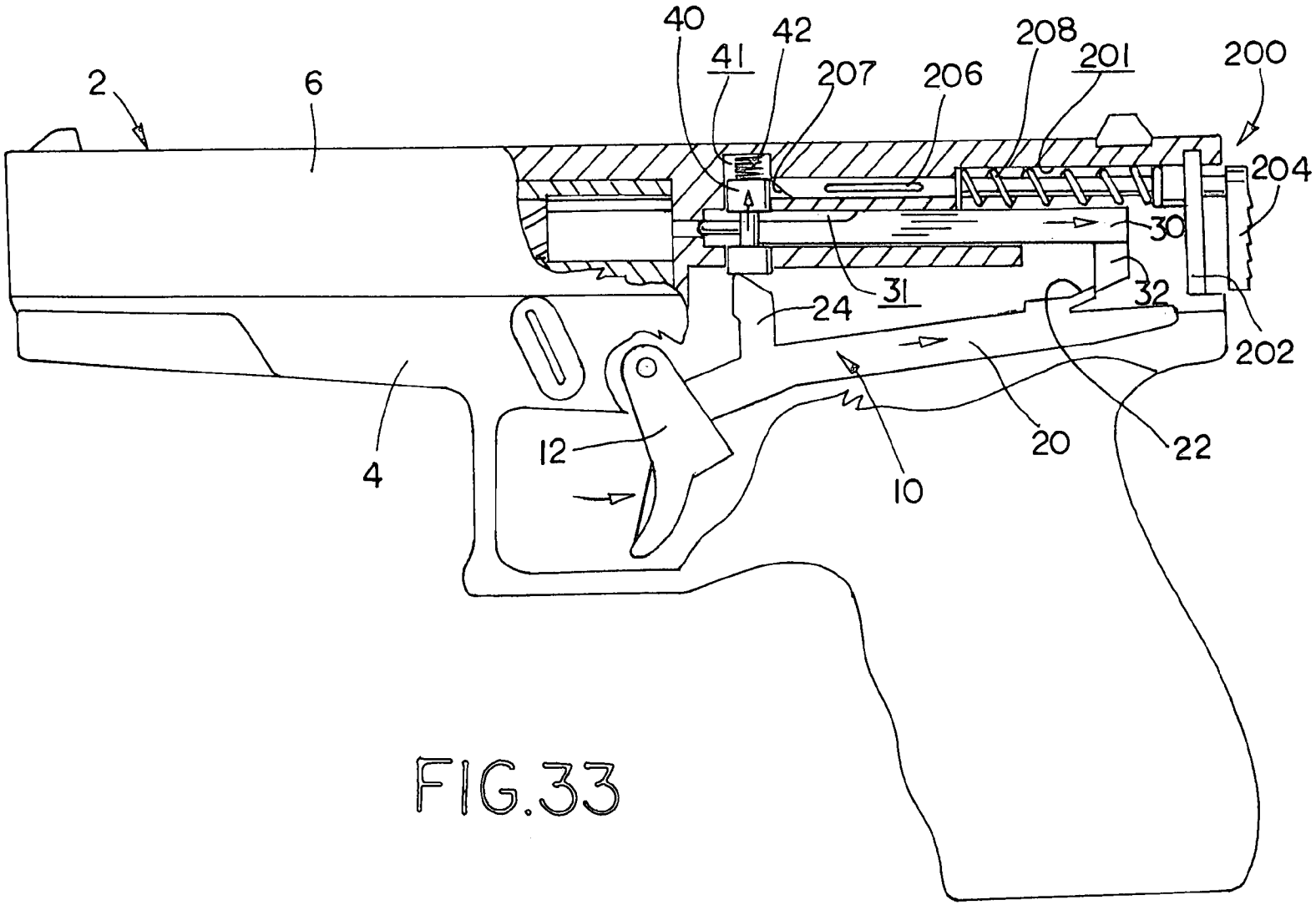
FIG. 33 is a side view with a cut away portion of the striker fired pistol and the safety device of FIG. 32 in the disengaged position showing the trigger and trigger bar moving rearward and the firing pin safety being lifted upward.
Figure 34:
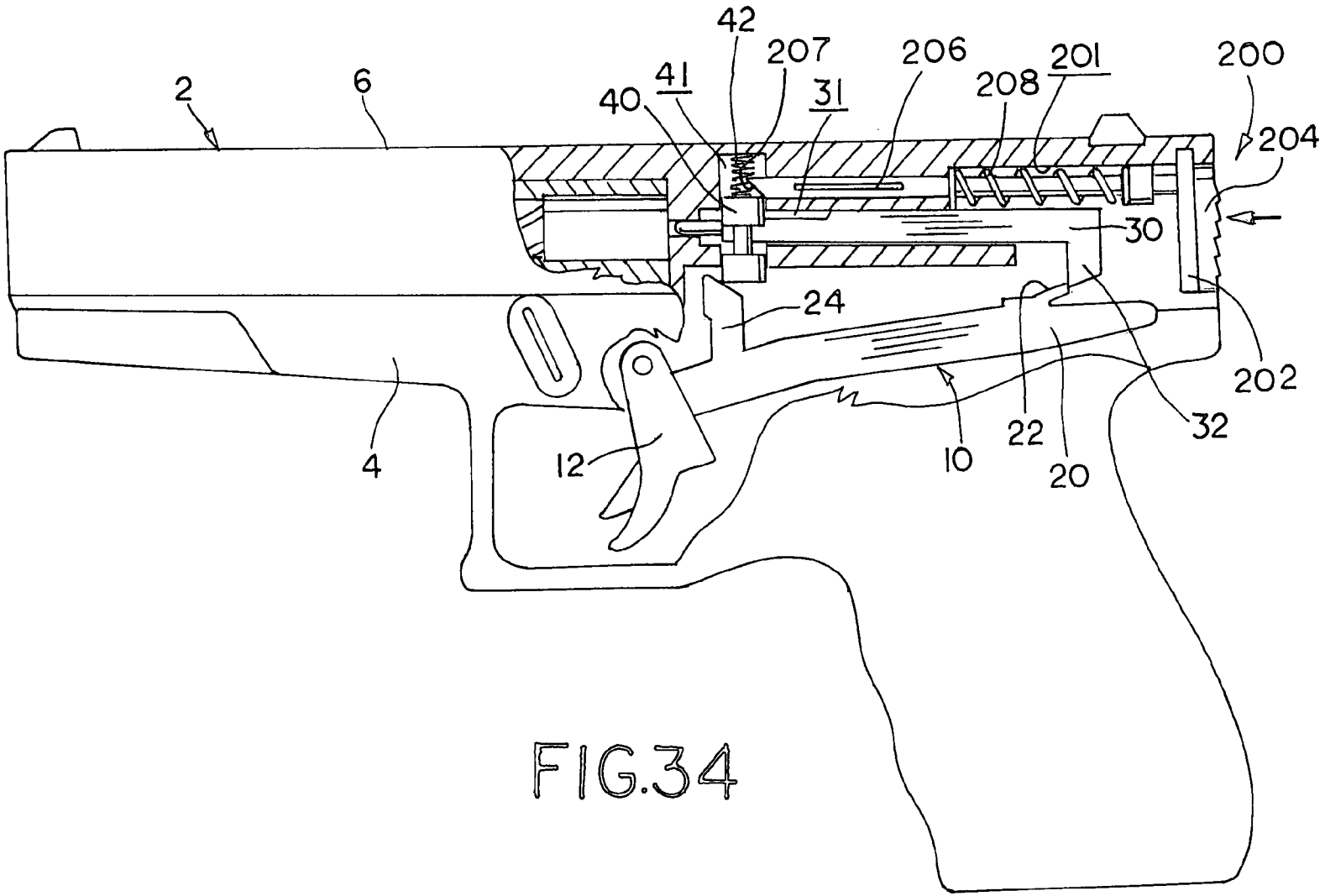
FIG. 34 is a side view with a cut away portion of the striker fired pistol and the safety device of FIG. 32 in the engaged position showing the contact bar seated over the firing pin safety.

FIGS. 32-34 illustrate an embodiment of the safety device, designated generally as reference numeral 200. Unlike the aforementioned embodiments, which block the movement of the striker, safety device 140 includes a plunger style contact member in the form of a reciprocating contact bar 206 that blocks the movement of the firing pin block 40 within the slide thereby preventing the pistol from inadvertent discharge without affecting the normal operation of the pistol's fire control mechanisms.

Safety device 200 includes an end plate 202 and thumb plate mounted to the end of contact bar 206. End plate 202 is configured to mount to the rear of slide 6. Contact bar 206 reciprocates within longitudinal channel 201 formed within slide 6. As shown, channel 201 opens into vertical bore 41, within which firing pin block 40 is seated. Contact bar 206 is seated in a coil spring 208 disposed within longitudinal channel 201. Spring 208 biases contact bar 206 rearward away from firing pin block 40. Contact bar 206 has an angled terminal end 207. As shown, contact rod 206 reciprocally extends through an opening in the end plate 202 for movement between an engaged position (FIG. 34) where thumb plate 164 abuts flat against end plate 162 and a disengaged position (FIGS. 32 and 33) where the thumb plate is spaced from the end plate.

When the user manually presses thumb plate 204, contact bar 206 is driven forward against the tension of spring 208 into the engaged position and seats over the top of firing pin block 40. With contact bar 206 inserted over firing pin block 40, the vertical movement of the firing pin block is obstructed thereby preventing the rearward movement of trigger bar 20 and trigger 12. Since firing pin block 40 cannot be raised to clear firing pin channel 31 when thumb plate 204 is manually pressed into the engaged position, pistol 2 cannot be discharged. When manual pressure is removed from thumb plate 204, spring 208 drives contact bar 206 rearward into the disengaged position, thereby allowing firing pin block 40 to be raised by trigger bar protrusion 24 during the normal cycle of operation. It should be noted that safety device 200 only acts on firing pin block 40 and only affects the operation of fire control mechanism 10 when the user manually applies pressure to thumb plate 204 to hold contact bar 206 in the engaged position over firing pin block 40.

Figure 35:
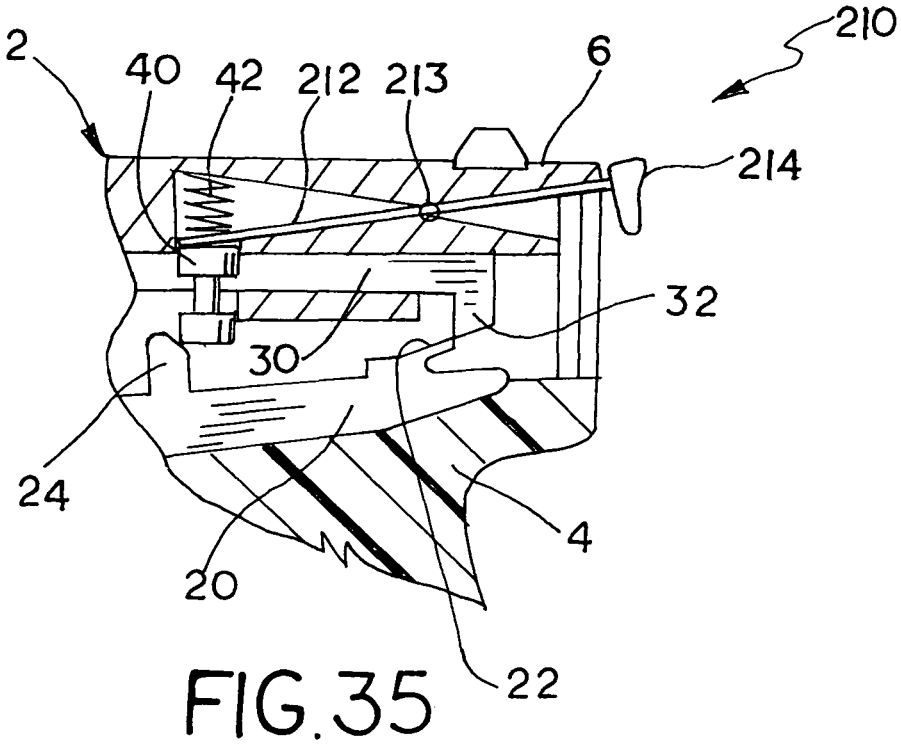
FIG. 35 is a partial sectional view of the rear of the striker fired pistol and an eighth embodiment of the safety device of this invention shown in the engaged position.
Figure 36:
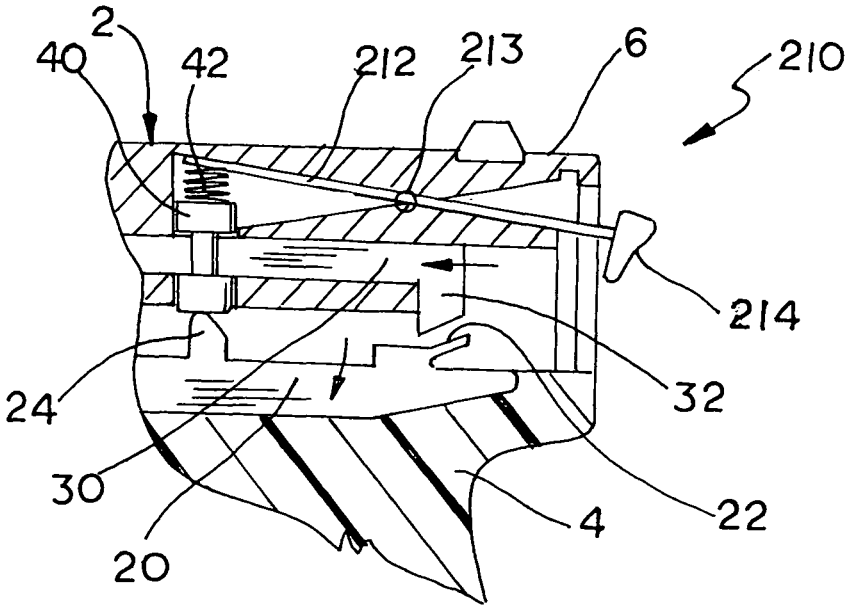
FIG. 36 is a partial sectional view of the rear of the striker fired pistol and the safety device of FIG. 35 shown in the disengaged position.
Figure 38:
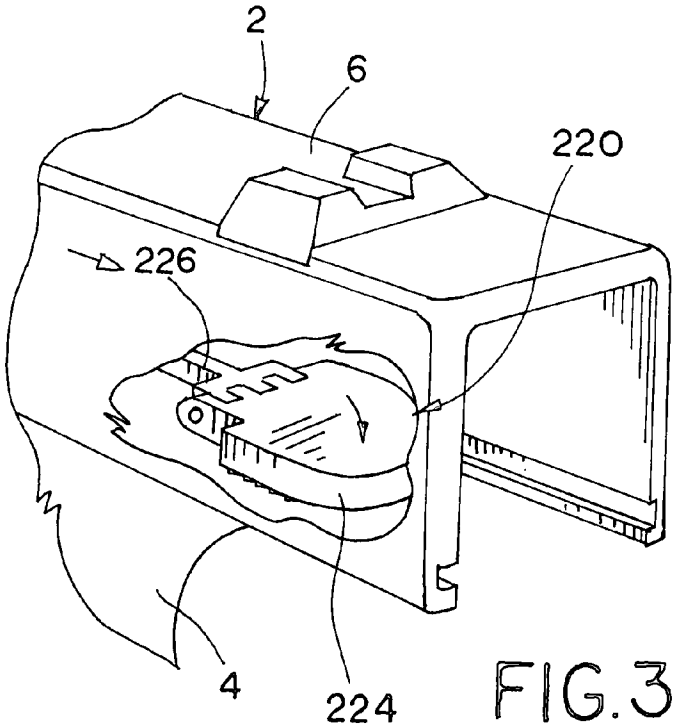
FIG. 38 is another partial perspective view of the rear of the striker fired pistol with the slide pulled back and the safety device of FIG. 37 folded downward.
Figure 37:
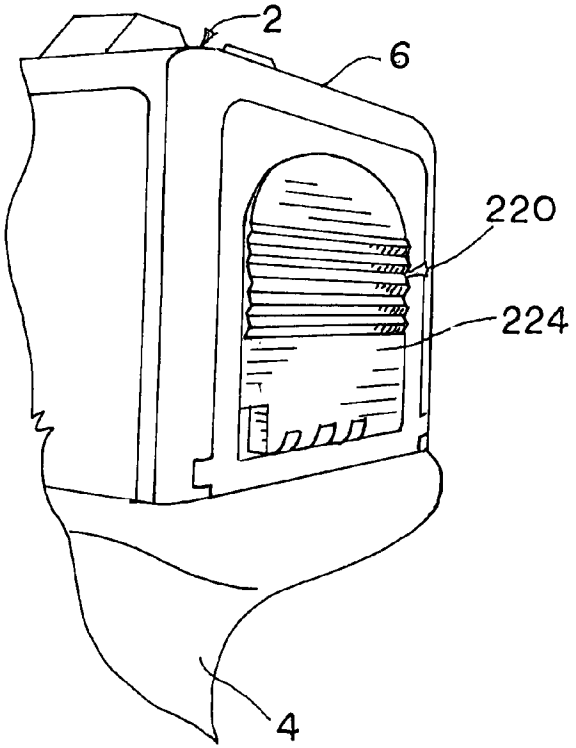
FIG. 37 is a partial perspective view of the rear of the striker fired pistol and a ninth embodiment of the safety device of this invention in the engaged position.
Figure 40:
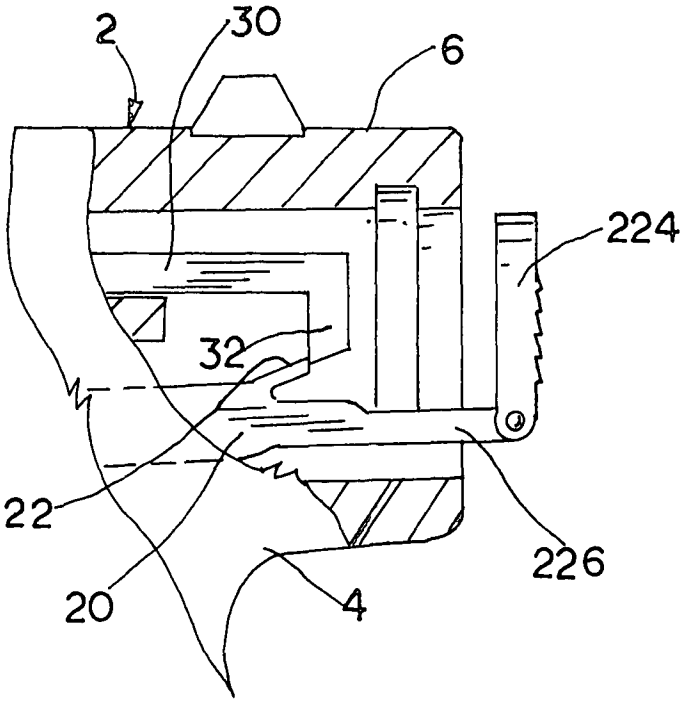
FIG. 40 is a partial sectional view of the rear of the striker fired pistol and the safety device of FIG. 37 showing the trigger bar and thumb plate moving rearward.
Figure 39:
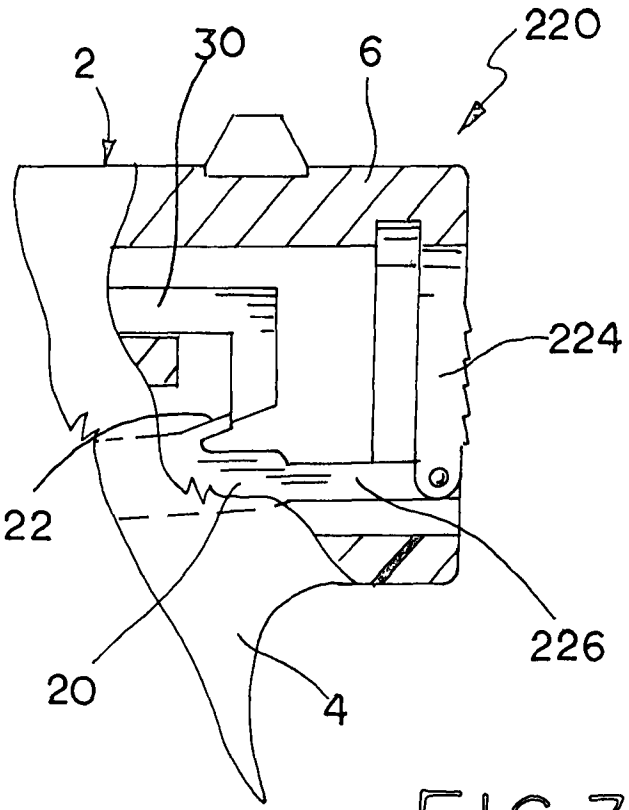
FIG. 39 is a partial sectional view of the rear of the striker fired pistol and the safety device of FIG. 37 showing the safety device in its engaged position.

FIGS. 35-36 illustrate an embodiment of the safety device, designated generally as reference numeral 210. Safety device 210 is another firing pin safety block type device similar to safety device 200 above, except that firing pin block 40 is obstructed by a contact member in the form of a pivoting lever arm 212 rather than a reciprocating contact bar. As shown, lever arm 212 is pivotally seated within a cavity formed in the slide 6 of pistol 2. Lever arm 212 pivots about pin 213. A lever button 214 is mounted to the distal end of lever arm 212, which extends from the end of slide 6. Manually elevating lever button 214 along the back of slide, pivots lever arm 212 downward, which holds firing pin block 40 down to prevent any rearward movement of trigger bar 20. Absent any manual pressure to raise lever button 214, rearward movement of trigger bar 20 raises firing pin block 40 to clear firing pin channel 31 and allow pistol 2 to be discharged.

FIGS. 37-40 illustrate an embodiment of the safety device, which is designated generally as reference numeral 220. In this embodiment, safety device 220 includes a contact member in the form of an integral extension 226 to trigger bar 20, to which a folding thumb plate 224 is pivotally connected. Again, thumb plate 224 acts as the activation button and is pivotally connected to trigger bar extension 226 in a piano hinge fashion, although other hinge type connections may be employed within the teachings of this invention. To engage, safety device 220, the user simply places his thumb over thumb plate 224 and holds it to the back of slide 6. Since thumb plate 224 is directly connected to trigger bar 20 integrally via extension 226, manual pressure applied to thumb plate 224 prevents any inadvertent movement of the trigger bar or any of the rest of fire control mechanism 10. When the pistol fires, slide 6 reciprocates rearward and thumb plate 224 simply folds downward out of the path of the slide.

Figure 41:
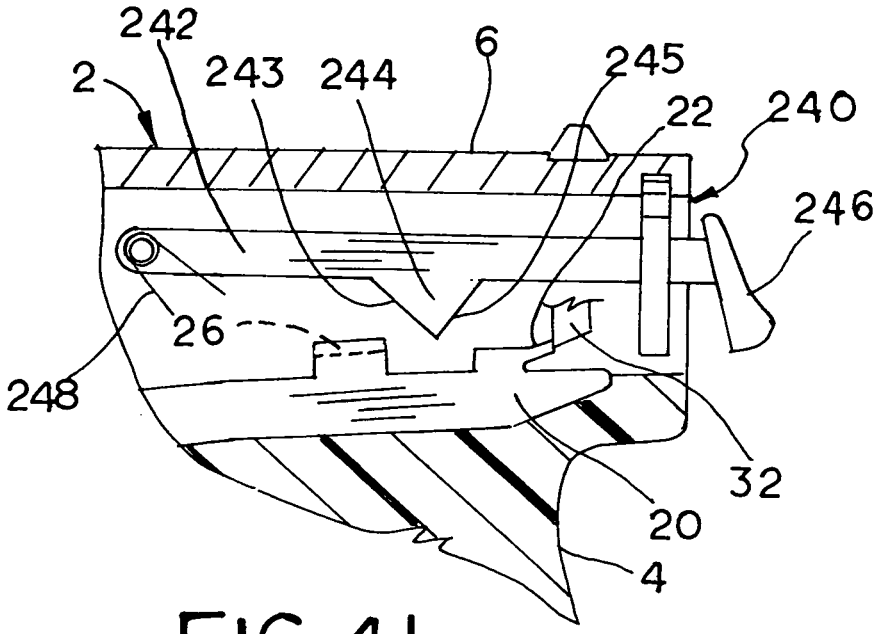
FIG. 41 is a partial sectional view of the rear of the striker fired pistol and a tenth embodiment of the safety device of this invention showing the safety device in the disengaged position.
Figure 42:
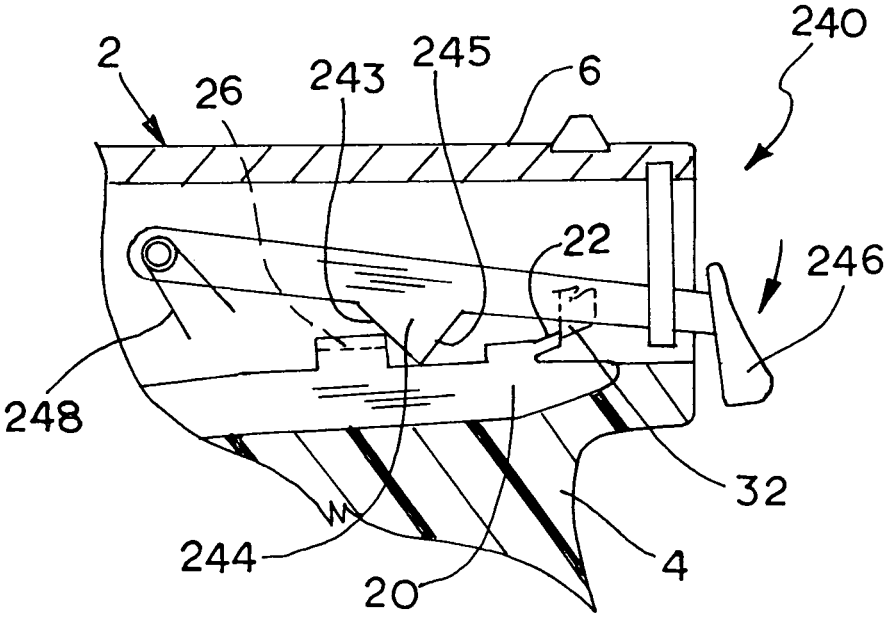
FIG. 42 is a partial sectional view of the striker fired pistol and the safety device of FIG. 41 showing the safety device in the engaged position.

FIGS. 41 and 42 illustrate an embodiment of the safety device, which is designated generally as reference numeral 240. In this embodiment, safety device 240 includes a contact member in the form of a lever arm 242, which blocks the movement of trigger bar 20. Lever arm 242 is pivotally disposed within slide 6 and pivots between a disengaged position and an engaged position to block the movement of trigger bar 20. A lever button 246 is mounted to the distal end of lever arm 242, which extends from the end of slide 6. Lever arm 242 has a triangular protrusion 244, which has an angled proximal edge 243 and an angled distal edge 245. A torsion spring 248 biases lever arm 242 into the disengaged position. In the disengaged position (FIG. 41), lever button 246 is elevated along the back of slide 6 and protrusion 244 is spaced from trigger bar 20, thereby allowing the trigger bar to move freely. In the engaged position (FIG. 42), lever button 246 is manually depressed and lever arm 242 is pivoted downward so that protrusion 244 abuts a protrusion 26 of trigger bar 20, thereby preventing any rearward movement of the trigger bar.

Figure 43:
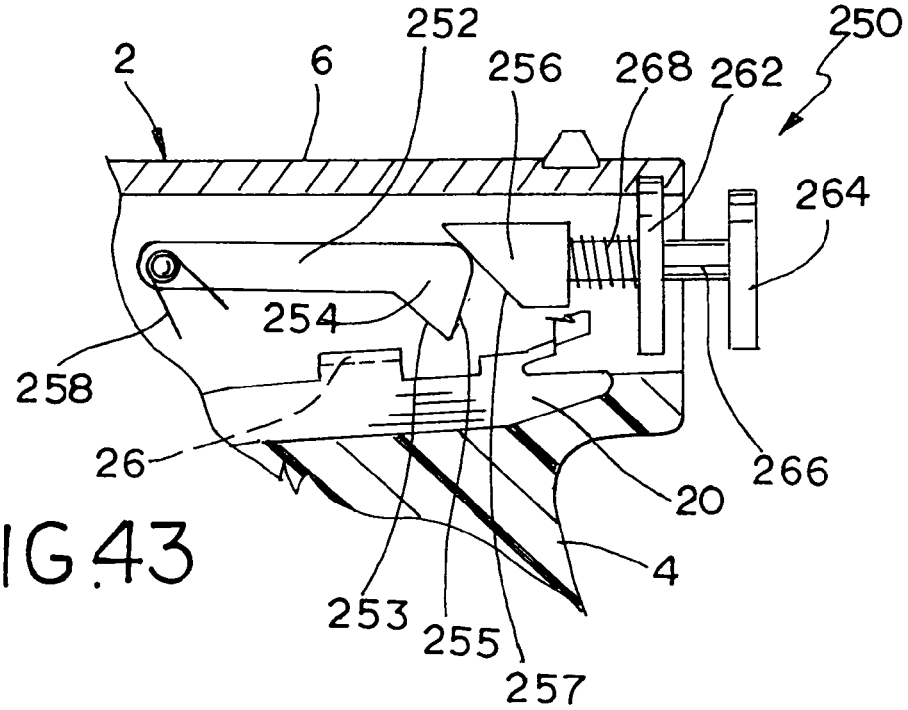
FIG. 43 is a partial sectional view of the rear of the striker fired pistol and a eleventh embodiment of the safety device of this invention showing the safety device in the disengaged position.
Figure 44:
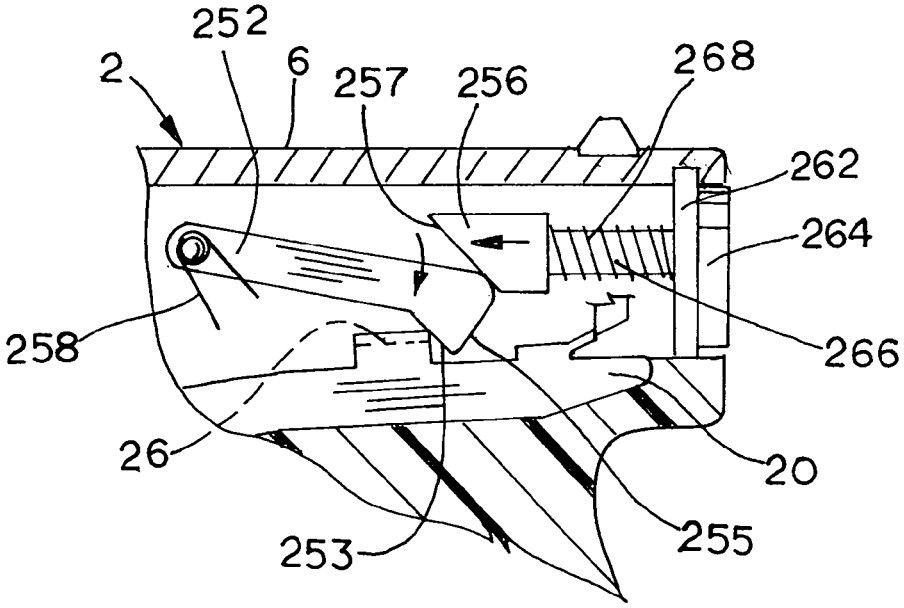
FIG. 44 is a partial sectional view of the rear of the striker fired pistol and the safety device of FIG. 43 showing the safety device in the engaged position.

FIGS. 43 and 44 illustrate another embodiment of the safety device, which is designated generally as reference numeral 250. In this embodiment, the contact member again takes the form of a lever arm 252, which again blocks the movement of trigger bar 20. Safety device 250 is similar to safety device 240, except that the internal lever arm 252 is actuated by a plunger type mechanism similar to that of Safety device 160. Safety device 250 includes a lever arm 252 which is pivotally disposed within slide 6. Again, lever arm 252 has a triangular protrusion 254, which has an angled proximal edge 253 and an angled distal edge 255. Again, a torsion spring 258 biases lever arm 252 into its disengaged position. Safety device 250 also includes an end plate 262 and a reciprocating thumb plate 264, which is mounted to a shaft 266 that slides through an opening in the end plate. Shaft 166 terminates in an angled head 256, which abuts the distal end of lever arm 252. In the disengaged position (FIG. 43), thumb plate 264 is spaced from end plate 262 and head 256 allows lever arm 252 to pivot freely. In the engaged position (FIG. 44), thumb plate 264 is depressed and head 256 forces lever arm 252 downward so that protrusion 254 abuts protrusion 26 of trigger bar 20, thereby preventing any rearward movement of the trigger bar.

It should be noted that safety devices 200, 220, 230, 240 and 250 are embodiments of the present invention, which are generally illustrated and described herein as being integrated into the design of the pistol and its fire control mechanism. Unlike safety devices 100, 120,130, 140, 150 and 160 which are embodiments illustrated and described generally as devices that replace the common slide cover plate on conventional striker fired weapons, these embodiments would generally require some degree of physical modification, machining and gun smithing for incorporation into a conventional weapon in order to accommodated the various added components and operation of each embodiment. Nevertheless, these particular embodiments of the present invention may be configured or adapted for use with any type, style or brand of striker fired weapon within the teaching of this invention.

One skilled in the art will note that the various embodiments of this invention provide an added measure of safety to striker fired semi-automatic pistols. Each embodiment of this invention includes a contact member in the form of a sliding bar or pivoting lever, that is movable between an engaged position and a disengaged position, such that the contact member operatively blocks the movement of one of the fire control mechanisms components to prevent discharge of the weapon but only when the contact member is manually held in an engaged position. The user manipulates and physically holds the contact member in its engaged position by pressing a thumb plate or button located at the rear of the slide. Safety devices of this invention only affect the fire control mechanism of the pistol while the user actively engages, that is physically presses on the thumb plate or button of the safety device to move the contact member into its engagement position, and must physically maintain pressure on the thumb plate in order to hold the contact member in its engaged position to block the movement of the fire control components. Unlike other firearm safety mechanisms that maintain the weapon in a safe condition and must be deactivated in order to fire the weapon, the normal operating condition of the safety devices of this invention is disengaged, meaning that the normal operation of the weapon is unchanged and the user must actively operate the device to prevent the weapon from firing. The safety devices of this invention require the constant and deliberate action of the user to remain engaged. The safety devices of this invention only operate to prevent movement of the fire control mechanism when the user applies adequate force to the device.

The safety device operates in conjunction with the fire control mechanism to transfer any movement of the trigger to the thumb plate or button only when the safety device is actively engaged. When the user actively engages the safety device by pressing the thumb plate or button with his thumb, any movement of the trigger, whether pressed intentionally or inadvertently, will give the user a subtle tactile "warning" through the safety device. While the user will receive a subtle tactile "warning" alerting the user of a potential hazard, the safety device provides enough mechanical advantage against the movement of the fire control mechanism that the manual pressure applied to the thumb plate or button to actively engage the safety device arrests the movement of the trigger that would result in the weapon discharging. The safety devices do not operatively contact or otherwise affect the function of the fire control mechanisms unless the safety device is intentionally and actively engaged by the user.

Each embodiment of the safety device works in conjunction with the weapon's fire control mechanism and supplements the other safety mechanism of conventional striker fired weapons. The safety devices are designed to minimize the potential for component wear or breakage, which could negatively impact the operation of the pistol. Moreover, because the safety devices do not contact or affect the normal operation of the weapon, the weapon will remain operable even if the device breaks or fails. Certain embodiments of this invention are designed to be replacement parts for the slide back cover and require no modification to the weapon or its fire control mechanism, which make these embodiments convenient and cost effective add-on devices for conventional striker fired weapons. Although not necessary for the function of the safety device, certain embodiments of this invention include a spring or similar component to holds the thumb plate in either engaged or disengaged position, which eliminates any rattling or noise caused by the moving about of the thumb plate when the user is not physically activating the safety device.

The safety devices of this invention also do not alter or affect the normal operation or use of the weapon. No extensive training or deviation from traditional weapon handling and shooting techniques or procedures are required to effectively use the safety device on a striker fired weapon. Actively engaging the safety devices not only blocks the movement of the fire control components, but the manual pressure applied to the device by the user's thumb also helps hold the slide in battery. The safety devices are particularly useful for reducing the risk of negligent discharges while holstering a striker fired weapon. The user simply places his thumb over the end of the slide to hold the safety device in its engaged position during reholstering or when the user wishes the additional safety measure provided by the device. To fire the weapon, the user assumes a traditional grip moving his thumb away from the slide and the weapon is instantly functional, even if the contact member remains in its engaged position. In absence of any manual pressure applied to the contact member in its engaged position, the normal operation of the fire control mechanism simply pushes the contact member into the disengaged position when the weapon is discharged.

The various embodiments of the present invention herein described and illustrated are not intended to be exhaustive or to limit the invention to the precise form disclosed, but are presented to explain the invention so that others skilled in the art might utilize its teachings. The various embodiments of the present invention may be modified within the scope of the following claims.

We claim:

1. A safety device for use in a striker fired semi-automatic weapon, which includes a frame, a reciprocating slide mounted to the frame, and a fire control mechanism disposed within the frame and the slide for actuating the discharge of a round from the pistol, the safety device comprising:

a first part adapted to mount adjacent the rear of the slide;

a second part shiftably connected to the first part for reciprocal movement between a disengaged position where the second part is spaced away from the first part and an engaged position where the second part is adjacent the first part; and an elongated protrusion extending from the second part past the first part, the protrusion constitutes means for blocking the movement of the fire control mechanism to prevent discharge of the weapon only when the second part is actively held with constant manual pressure in the engaged position.

2. The safety device of claim 1 wherein the first part is a slide cover plate.

3. The safety device of claim 2 wherein the slide cover plate has an opening therein through which the protrusion reciprocally extends.

4. The safety device of claim 1 wherein the second part is a thumb plate pivotally mounted to the first part and the protrusion swings through an opening formed in the first part.

5. The safety device of claim 1 wherein the protrusion is a curved leg extending under the first part.

6. The safety device of claim 1 wherein the protrusion has a first surface for restrictively contacting the fire control mechanism when the second part is in the engaged position and a second surface for contacting the first part when the second part is in the disengaged position.

7. The safety device of claim 1 and a spring operatively connected between the first part and second part for urging the second plate related to the first part in one of the engaged position and the disengaged position.

8. A safety device for use in a striker fired semi-automatic weapon, which includes a frame, a reciprocating slide mounted to the frame, and a striker part disposed within the slide for reciprocal movement within the slide for actuating the discharge of a round from the weapon, the safety device comprising:

a first part adapted to mount to the rear of the slide;

a second part shiftably connected to the first part for reciprocal movement between a disengaged position where the second part is spaced away from the first part and an engaged position where the second part is adjacent the first part; and an elongated protrusion extending from the second part past the first part, the protrusion constitutes means for blocking the shiftable movement of the striker to prevent discharge of the weapon only when the second part is actively held with constant manual pressure in the engaged position.

9. The safety device of claim 8 wherein the first part is a slide cover plate.

10. The safety device of claim 9 wherein the slide cover plate has an opening therein through which the protrusion reciprocally extends.

11. The safety device of claim 8 wherein the second part is a thumb plate pivotally mounted to the first part and the protrusion swings through an opening formed in the first part.

12. The safety device of claim 8 wherein the protrusion is a curved leg extending under the first part.

13. The safety device of claim 8 wherein the protrusion has a first surface for restrictively contacting the striker when the second part is in the engaged position and a second surface for contacting the first part when the second part is in the disengaged position.

14. The safety device of claim 8 and a spring operatively connected between the first part and second part for urging the second plate related to the first part in one of the engaged position and the disengaged position.

15. A safety device for use in a striker fired semi-automatic weapon, which includes a frame, a reciprocating slide mounted to the frame, and a firing pin block shiftably disposed within the slide for actuating the discharge of a round from the weapon, the safety device comprising:

a first part adapted to mount adjacent the rear of the slide;

a second part shiftably connected to the first part for reciprocal movement between a disengaged position where the second part is spaced away from the first part and an engaged position where the second part is adjacent the first part; and an elongated protrusion extending from the second part past the first part, the protrusion constitutes means for blocking the shiftable movement of the firing pin block to prevent discharge of the weapon only when the second part is actively held with constant manually pressure in the engaged position.

16. The safety device of claim 15 wherein the first part is a slide cover plate.

17. The safety device of claim 16 wherein the slide cover plate has an opening therein through which the protrusion reciprocally extends.

18. The safety device of claim 15 wherein the protrusion is an elongated member extending through the first part.

19. The safety device of claim 15 wherein the protrusion has a first surface for restrictively contacting the firing pin block when the second part is in the engaged position.

20. The safety device of claim 15 and a spring operatively connected between the first part and second part for urging the second plate related to the first part in one of the engaged position and the disengaged position.

21. A safety device for use in a striker fired semi-automatic weapon, which includes a frame, a reciprocating slide mounted to the frame and having a rear end and a fire control mechanism disposed within the frame and slide for actuating the discharge of a round from the pistol, the safety device comprising:

an elongated contact member shiftably mounted to the slide and extending partially from the slide for movement between an engaged position where the contact member is positioned within the slide to contact the fire control mechanism and a disengaged position where the contact member is spaced from the fire control mechanism, the contact member constitutes means for blocking the movement of the fire control mechanism to prevent discharge of the weapon only when the contact member is manually held in an engaged position.

22. The safety device of claim 21 also comprises a first part adapted to mount to the rear of the slide; and a second part shiftably connected to the first part for reciprocal movement between a disengaged position where the second part is spaced away from the first part and an engaged position where the second part is adjacent the first part, the contact member extending from the second part past the first part.

23. The safety device of claim 21 wherein the first part is a slide cover plate.

24. The safety device of claim 23 wherein the slide cover plate has an opening therein through which the protrusion reciprocally extends.

25. The safety device of claim 21 wherein the second part is a thumb plate pivotally mounted to the first part and the protrusion swings through an opening formed in the first part.

26. The safety device of claim 21 wherein the contact member is a curved protrusion extending under the first part.

27. The safety device of claim 21 wherein the contact member has a first surface for restrictively contacting the fire control mechanism when the second part is in the engaged position and a second surface for contacting the first part when the second part is in the disengaged position.

28. The safety device of claim 21 and a spring operatively connected to the contact member for urging the contact member towards one of the engaged position and the disengaged position.

29. In combination, a striker fired semi-automatic weapon, which includes a frame, a reciprocating slide mounted to the frame and a fire control mechanism operatively disposed within the frame and slide for discharging a round from the pistol, and a safety device for selectively preventing discharge of the weapon, the combination comprising:

the fire control mechanism includes a firing pin block shiftably disposed within the slide, an elongated contact member shiftably mounted to the slide and extending partially from the slide for movement between an engaged position where the contact member is positioned within the slide to contact the fire control mechanism and a disengaged position where the contact member is spaced from the fire control mechanism, the contact member constitutes means for blocking the shiftable movement of the firing pin block to prevent discharge of the weapon only when the second part is actively held with constant manual pressure in the engaged position.

30. The combination of claim 29 wherein the contact member is reciprocally seated within a bore formed in the slide, the contact member has a first end thereof that is seated against the firing pin block when the contact member is in the engaged position.

31. The safety device of claim 29 and a spring operatively connected to the contact member within the slide for urging the contact member to one of the engaged position and the disengaged position.

32. The combination of 31 wherein the contact member also has a second end thereof extending from the slide rear end at a first position relative to the slide rear end when the contact member is in the engaged position and at a second position relative to the slide rear end when the contact member is in the disengaged position.

33. A method for reholstering a striker fired weapon where weapon includes a frame, a reciprocating slide mounted to the frame and having a rear end thereof, a fire control mechanism disposed within the frame and slide for actuating the discharge of a round from the pistol, and an elongated contact member shiftably mounted to the slide and extending partially from the slide rear end for movement between an engaged position where the contact member is positioned within the slide to contact the fire control mechanism and a disengaged position where the contact member is spaced from the fire control mechanism, the method comprising the following steps:

a. gripping the weapon in one hand with the fingers of the hand spaced from the fire control mechanism;

b. placing the thumb over the slide rear end;

c. pressing the contact member in to the engaged position; and d. manually holding the contact member in the engaged position while inserting the weapon into the holster.

* * * * *